US012398725B2

(12) United States Patent
Buys et al.

(10) Patent No.: US 12,398,725 B2
(45) Date of Patent: Aug. 26, 2025

(54) MULTI-PHASE ROTOR, SYSTEM AND METHOD FOR MAINTAINING A STABLE VAPOUR CAVITY

(71) Applicant: Cre 8 Technologies Limited, Auckland (NZ)

(72) Inventors: Alan Buys, Auckland (NZ); Clifford Roy Warner, Auckland (NZ)

(73) Assignee: Cre 8 Technologies Limited, Auckland (NZ)

( * ) Notice: Subject to any disclaimer, the term of this patent is extended or adjusted under 35 U.S.C. 154(b) by 0 days.

(21) Appl. No.: 18/715,101

(22) PCT Filed: Dec. 9, 2022

(86) PCT No.: PCT/IB2022/061955
§ 371 (c)(1),
(2) Date: May 30, 2024

(87) PCT Pub. No.: WO2023/105471
PCT Pub. Date: Jun. 15, 2023

(65) Prior Publication Data

US 2025/0020136 A1 Jan. 16, 2025

(30) Foreign Application Priority Data

Dec. 10, 2021 (NZ) ..... 783383

(51) Int. Cl.
*F04D 29/22* (2006.01)
*F04D 5/00* (2006.01)

(52) U.S. Cl.
CPC ..... *F04D 29/2255* (2013.01); *F04D 5/00* (2013.01)

(58) Field of Classification Search
CPC .... F04D 5/00; F04D 29/2238; F04D 29/2255; F04D 29/2277
See application file for complete search history.

(56) References Cited

U.S. PATENT DOCUMENTS

| | | | | |
|---|---|---|---|---|
| 2,603,160 | A | 7/1952 | La Bour | |
| 4,403,911 | A | 9/1983 | Possell | |
| 4,439,200 | A | 3/1984 | Meyer et al. | |
| 2025/0020136 | A1 * | 1/2025 | Buys | F04D 11/00 |

FOREIGN PATENT DOCUMENTS

| | | | |
|---|---|---|---|
| GB | 1063096 | A | 3/1967 |
| GB | 1597655 | A | 9/1981 |
| GB | 1599908 | A | 10/1981 |
| GB | 2074662 | A | 11/1981 |
| JP | 2012097696 | A | 5/2012 |
| RU | 2456477 | C1 | 7/2012 |

OTHER PUBLICATIONS

Feb. 23, 2023—(WO) International Search Report & Written Opinion—App. No. PCT/IB2022/061955.

* cited by examiner

*Primary Examiner* — Christopher R Legendre
(74) *Attorney, Agent, or Firm* — Banner & Witcoff, Ltd.

(57) ABSTRACT

A multi-phase rotor comprising a disk body, an inlet to receive a liquid into the rotor, and at least one outlet configured to expel the liquid from the internal rotor cavity. A flow path is provided between the inlet and the at least one outlet by a liquid intake channel and internal rotor cavity. The rotor is configured to be rotatable about an axis of rotation and a continuous stable vapour cavity is formed in the internal rotor cavity as the rotor rotates above a stable cavity threshold rotational speed.

19 Claims, 15 Drawing Sheets

MULTI-PHASE ROTOR, SYSTEM AND METHOD FOR MAINTAINING A STABLE VAPOUR CAVITY

CROSS-REFERENCE TO RELATED APPLICATIONS

The present application claims priority from and is a U.S. National Phase of International Application No. PCT/IB2022/061955, which was filed on Dec. 9, 2022, designating the United States of America and claiming priority to New Zealand Patent Application No. 783383, filed on Dec. 10, 2021. This application claims priority to and the benefit of the above-identified applications, which are all fully incorporated by reference herein in their entireties.

FIELD OF THE INVENTION

The present invention relates to a multi-phase rotor, system and method for maintaining a stable vapour cavity. More particularly, but not exclusively, it relates to an apparatus, system and method for moving liquids or providing a vacuum source.

BACKGROUND OF THE INVENTION

Devices involving liquid displacement through the device are typically carefully designed to operate within specific operational parameters, to limit issues relating to damaging behaviour due to the liquid. For example, centrifugal pumps are known to be susceptible to damage due to cavitation.

As pressure drops to near or below the vapour-pressure point of a liquid, cavitation occurs where a change of state (phase change) from liquid to gas and then back to liquid occurs. Depending on its precise location, it may cause severe mechanical damage and/or influence performance negatively. Typically, the change from liquid to gas tends to negatively impact performance and the change from gas to liquid may lead to mechanical damage.

Characteristically, constraints to avoid cavitation issues require device design and operation to be specific. Further, these devices typically have a narrow range of operational characteristics. Traditional centrifugal pumps, for example, are limited in the amount of acceleration energy they can impart into a liquid by the liquid's propensity to cavitate. When the imparted cumulative tensional acceleration at any point is greater than the liquid's inter-molecular attraction force (i.e., its vapour-pressure) to resist the applied acceleration forces, these pumps cease effective and/or sustainable operation.

In this specification, where reference has been made to external sources of information, including patent specifications and other documents, this is generally for the purpose of providing a context for discussing the features of the present invention. Unless stated otherwise, reference to such sources of information is not to be construed, in any jurisdiction, as an admission that such sources of information are prior art or form part of the common general knowledge in the art.

For the purpose of this specification, where method steps are described in sequence, the sequence does not necessarily mean that the steps are to be chronologically ordered in that sequence, unless there is no other logical manner of interpreting the sequence.

It is an object of the present invention to provide an apparatus, system and method for maintaining a stable vapour cavity which overcomes or at least partially ameliorates some of the abovementioned disadvantages or which at least provides the public with a useful choice.

BRIEF DESCRIPTION OF THE INVENTION

According to a first aspect the invention broadly comprises a multi-phase rotor comprising:

- a disk body, the rotor configured to be rotatable about an axis of rotation;
- an inlet to receive a liquid into the rotor;
- a liquid intake channel extending from the inlet;
- an internal rotor cavity extending radially around the liquid intake channel, the internal cavity is inside the disk body; and
- at least one outlet configured to expel the liquid from the internal rotor cavity;
- wherein a flow path is provided between the inlet and the at least one outlet by the liquid intake channel and internal rotor cavity; and
- wherein a continuous stable vapour cavity is formed in the internal rotor cavity as the rotor rotates above a stable cavity threshold rotational speed;
  - wherein the inlet comprises an inlet restriction configured to constrain an inlet liquid mass at the inlet forming a liquid seal at the inlet as the rotor rotates about the axis of rotation; and
- wherein the at least one outlet comprises an outlet restriction configured to retain an outlet liquid mass towards the outlet forming a liquid seal at the outlet as the rotor rotates about the axis of rotation.

According to another aspect the at least one outlet is located towards or at the outermost regions of the internal rotor cavity According to another aspect the continuous stable vapour cavity is formed between and separates the outlet liquid mass at the outlet and an inlet liquid mass located at the inlet.

According to another aspect the continuous stable vapour cavity is a low-pressure vapour cavity having a pressure less than an external ambient pressure.

According to another aspect the internal rotor cavity forms a ring around the liquid intake channel.

According to another aspect the stable cavity threshold rotational speed is greater than a cavitation phase threshold rotational speed at which cavitation initially occurs.

According to another aspect the multi-phase rotor comprises a plurality of outlets.

According to another aspect the liquid seal allows liquid to pass out through the at least one outlet.

According to another aspect wherein the liquid seal(s) prevent venting of ambient gas into the rotor through the inlet and/or the at least one outlet.

According to another aspect the outlet restriction is an outlet constriction wherein the outlet comprises a region of reduced area.

According to another aspect the at least one outlet has a diameter less than the inlet.

According to another aspect the outlet is approximately 2 mm to 6 mm in diameter.

According to another aspect the outlet is approximately 4 mm in diameter.

According to another aspect the outlet restriction is a liquid trap feature located at the at least one outlet to prevent venting of ambient gas through the outlet liquid mass into the continuous stable vapour cavity.

According to another aspect the liquid trap feature maintains the outlet liquid mass to provide a seal at the outlet between the stable vapour cavity and ambient gas.

According to another aspect the liquid trap feature comprises a counter-acceleration routing geometry.

According to another aspect the liquid trap feature is a S-trap.

According to another aspect the rotor does not comprise of vanes or blades.

According to another aspect liquid mass flow capability at the inlet is a function of:

a) the continuous stable vapour cavity, b) external ambient pressure, and c) size of the inlet.

According to another aspect liquid mass flow capability at the outlet is a function of:

a) the continuous stable vapour cavity, b) external ambient pressure, c) size of the at least one outlet and/or outlet restriction, and d) rotational speed of the rotor.

According to another aspect the inlet is located at a bottom of the rotor.

According to another aspect the liquid intake channel extends vertically upwards from the inlet.

According to another aspect the liquid intake channel is coaxial with the axis of rotation.

According to another aspect the liquid intake channel comprises a cone shape for self-priming.

According to another aspect the internal rotor cavity is on a plane perpendicular to the axis of rotation.

According to another aspect the liquid is water.

According to another aspect the invention broadly comprises a stable vapour cavity forming system comprising:

a multi-phase rotor as described in any one of the previous clauses; and a liquid source.

According to another aspect the liquid source is a container of liquid.

According to another aspect the system is used to pump liquid.

According to another aspect the system further comprises a conduit extending between the internal rotor cavity and an external of the rotor to provide a vacuum source.

According to another aspect the system further comprises an outflow conduit extending between the internal rotor cavity and an external of the rotor to provide a fluid flowpath for liquid exiting the internal rotor cavity.

According to another aspect the outflow conduit is stationary relative to the rotating multi-phase rotor.

According to another aspect one end of the outflow conduit provides access to the liquid within the internal rotor cavity at another end of the outflow conduit provides an outlet for the rotor.

According to another aspect the system further comprises an intake conduit extending into the internal rotor cavity to introduce liquid into the rotor from a liquid source.

According to another aspect the inflow and/or outflow conduit is non-coaxial relative to the inlet and/or the axis of rotation of the rotor.

According to another aspect the inflow and/or outflow conduit comprises a circular, triangular, or square profile.

According to another aspect the invention broadly comprises a method for maintaining a stable vapour cavity comprising:

providing a multi-phase rotor comprising:

a disk body, the rotor configured to be rotatable about an axis of rotation;

an inlet to receive a liquid into the rotor;

a liquid intake channel extending from the inlet;

an internal rotor cavity extending radially around the liquid intake channel; and at least one outlet configured to expel the liquid from the internal rotor cavity;

wherein a flow path is provided between the inlet and the at least one outlet by the liquid intake channel and internal rotor cavity; and wherein a continuous stable vapour cavity is formed in the internal rotor cavity as the rotor rotates above a stable cavity threshold rotational speed;

introducing a liquid to the rotor through the inlet; and spinning the rotor;

the multi-phase rotor operates in a pre-cavitation phase, inter-cavitational phase and a post-cavitation phase and the stable vapour cavity is formed and maintained in the post-cavitation phase; and in the post cavitation phase the continuous stable vapour cavity forms around the liquid intake channel.

According to another aspect the rotor spins to initially fill with fluid such that the rotor is self-priming.

According to another aspect the method further comprises spinning the rotor above a stable cavity threshold rotational speed to form the stable vapour cavity in the internal rotor cavity.

According to another aspect the multi-phase rotor comprises an intake system and an outflow system, the method further comprising spinning the rotor such that the outflow system comprises a greater liquid mass flow capability than the intake system to form the stable vapour cavity in the post-cavitational phase.

According to another aspect the outflow system and the intake system comprises a greater liquid mass flow capability than the outflow system in the pre-cavitational phase.

According to another aspect the continuous stable vapour cavity forms around the liquid intake channel in plan view, the continuous stable vapour cavity comprises a cavity diameter.

According to another aspect the cavity diameter increases with rotational speed such that the cavity diameter at high rotational speeds is greater than at low rotational speeds.

According to another aspect the rotor provides a constant flow rate of liquid ejected from the at least one outlets at any rotational speed in the post-cavitation phase.

According to another aspect the liquid is introduced to the rotor from a liquid source.

Other aspects of the invention may become apparent from the following description which is given by way of example only and with reference to the accompanying drawings.

As used herein the term "and/or" means "and" or "or", or both.

As used herein "(s)" following a noun means the plural and/or singular forms of the noun.

The term "comprising" as used in this specification and claims means "consisting at least in part of". When interpreting statements in this specification and claims which include that term, the features, prefaced by that term in each statement, all need to be present but other features can also be present. Related terms such as "comprise" and "comprised" are to be interpreted in the same manner.

BRIEF DESCRIPTION OF THE DRAWINGS

The invention will now be described by way of example only and with reference to the drawings in which.

DETAILED DESCRIPTION OF PREFERRED EMBODIMENTS

According to various aspects of the present invention as illustrated in FIGS. 1-13D, there is provided a multi-phase rotor 1, system and method for maintaining a stable vapour cavity 20 which will now be described. It will be appreciated that these figures illustrate the general principles of the structure and construction, and that the invention is not limited to the precise configurations illustrated.

The multi-phase rotor 1 preferably has a pre-cavitation phase, a transitional inter-cavitational phase and a post-cavitation phase, in which it is intended to operate.

Figure 6A:
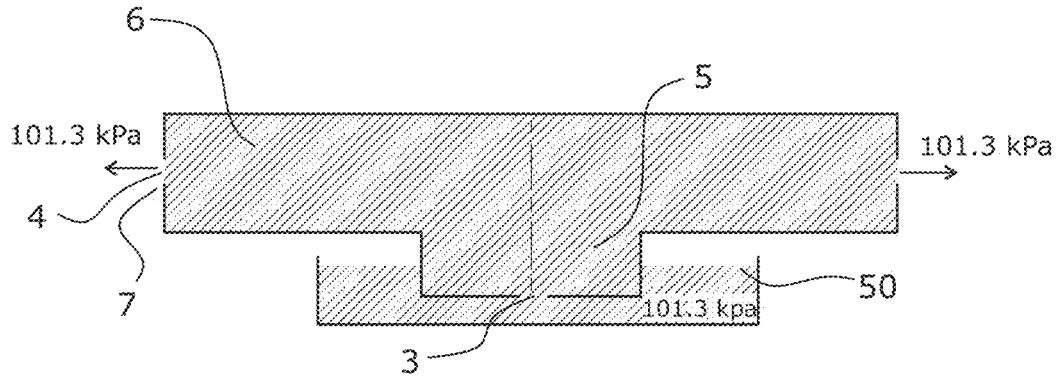
FIG. 6A shows a side view schematic of the multi-phase rotor filled with liquid in a pre-cavitation phase.

In the pre-cavitation phase (as shown in FIG. 6A), liquid flows through the device as a single body of liquid without vapour filled cavities. Pre-cavitation phase occurs at low rotational speeds (i.e., low revolutions per minute "RPM".)

Cavitation occurs when liquid in a device is subject to lower than vapour-pressure pressures, typically—but not exclusively, at higher rotational speeds.

Figure 6B:
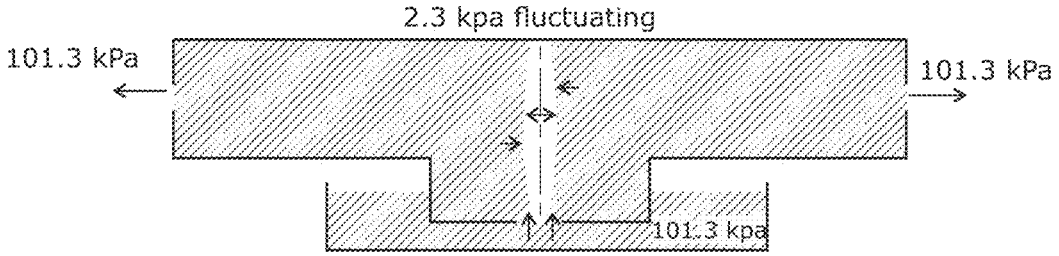
FIG. 6B shows a side view schematic of the multi-phase rotor with liquid in an inter-cavitation phase where there is initial formation of vapour cavities.

In an inter-cavitation phase (as shown in FIG. 6B) initial fluctuating vapour cavities form (which are not yet stable). Vapour filled cavities form as the liquid changes state to gas (boils), as a result of pressure dropping to near or below the vapour-pressure point of a liquid. When pressure increases sufficiently the gas changes state back to liquid (condenses), often causing mechanical damage in conventional devices. This liquid/gas/liquid phase change is the basic cycle that constitutes cavitation.

Figure 6C:
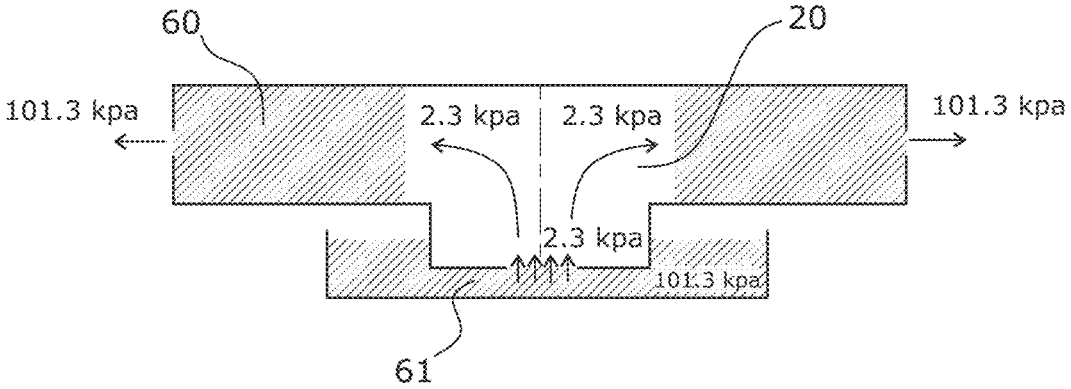
FIG. 6C shows a side view schematic of the multi-phase rotor having formed a stable vapour cavity in a post-cavitation phase.
Figure 6D:
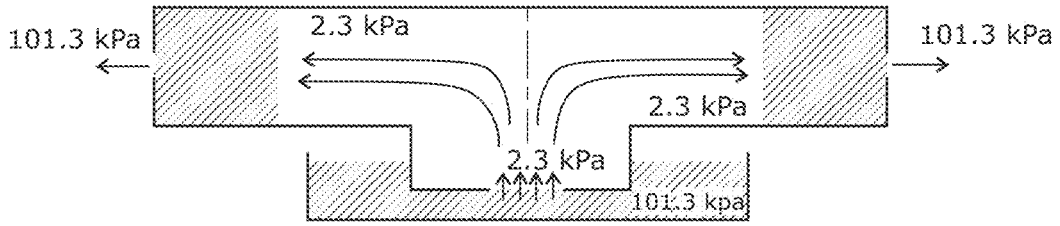
FIG. 6D shows a side view schematic of the multi-phase rotor having formed a stable vapour cavity in a post-cavitation phase at a higher rotational speed than 6C.
Figure 6E:
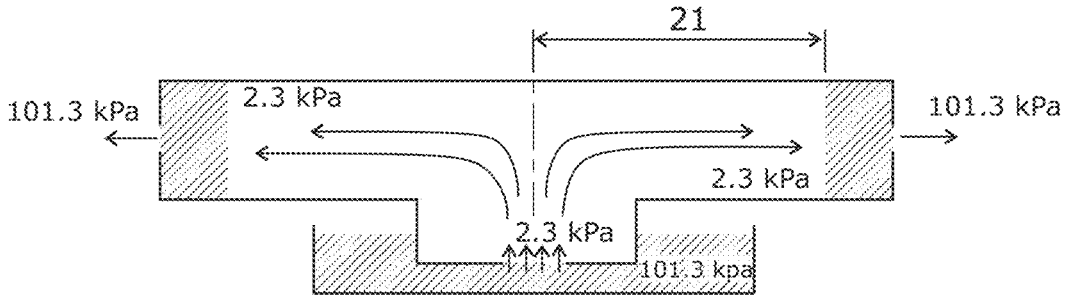
FIG. 6E shows a side view schematic of the multi-phase rotor having formed a stable vapour cavity in a post-cavitation phase at a higher rotational speed than 6D.
Figure 6F:
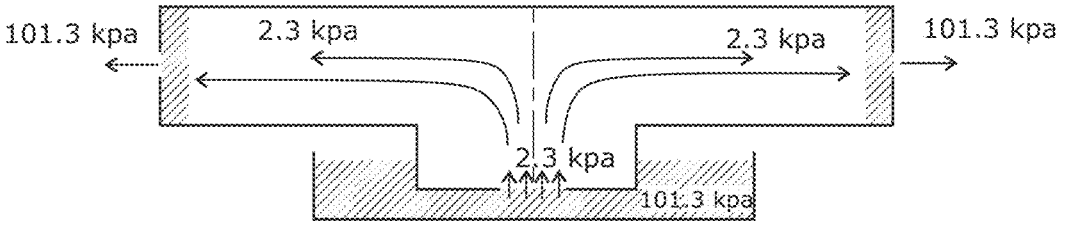
FIG. 6F shows a side view schematic of the multi-phase rotor having formed a stable vapour cavity in a post-cavitation phase at a higher rotational speed than 6D.

In the preferred configurations for stable operation of the device, in the post-cavitation phase (as shown in FIG. 6C), a continuous stable vapour cavity 20 is formed within the multi-phase rotor 1 as provided by the structure, now described in detail.

Device Structure

Figure 1:
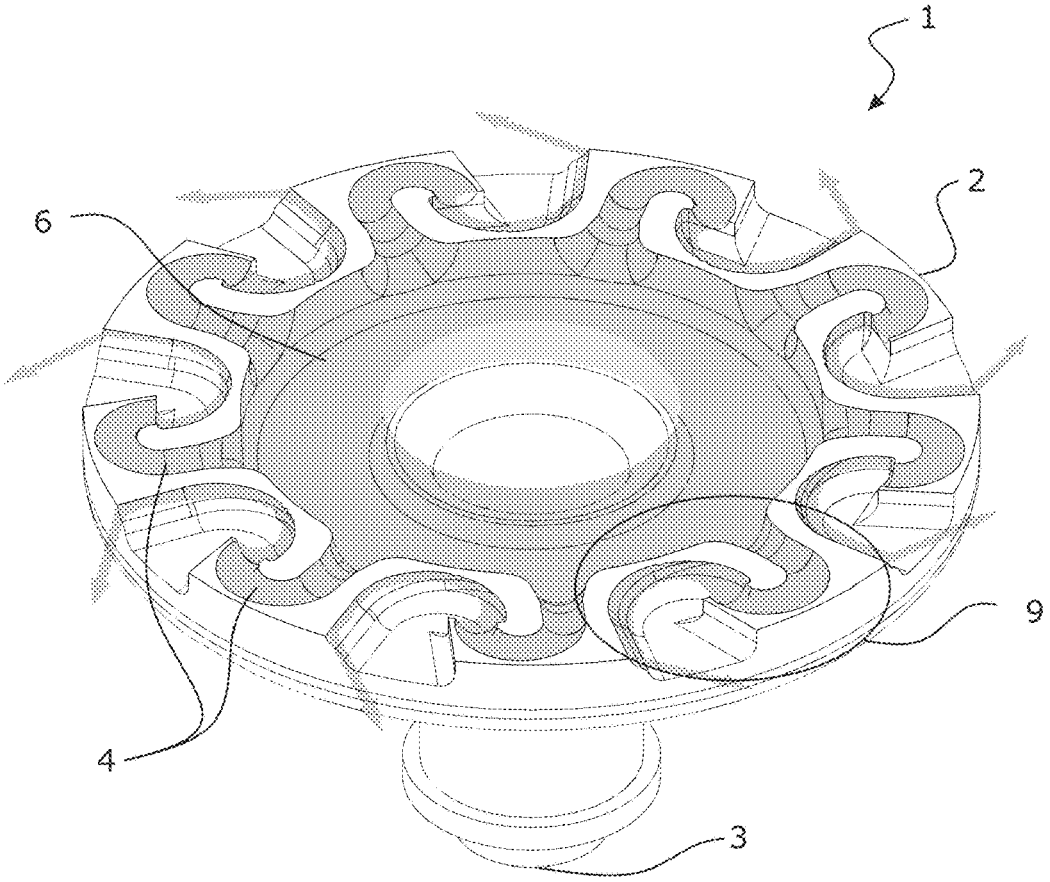
FIG. 1 shows a cross-section of a multi-phase rotor.

As shown in FIG. 1, the present invention relates to a multi-phase rotor 1. The multi-phase rotor 1 comprises a disk body 2, an inlet 3 to receive a liquid into the rotor 1 and at least one outlet 4 for expelling liquid.

In the preferred configurations, the multi-phase rotor 1 comprises a plurality of outlets 4. It should be appreciated a plurality of outlets 4 may allow for balanced/stable outflow of liquid out of the rotor 1.

In the preferred configurations, in the post-cavitation phase, a continuous stable vapour cavity 20 is formed in an internal cavity 6 of the rotor 1, as the device rotates above a stable cavity threshold rotational speed.

Figure 4A:
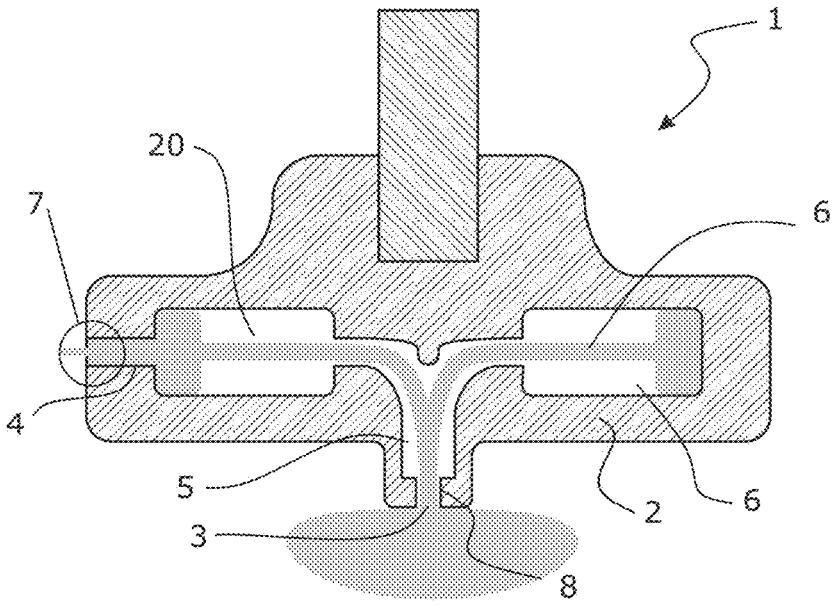
FIG. 4A shows a cross-sectional side view schematic of the multi-phase rotor.
Figure 4B:
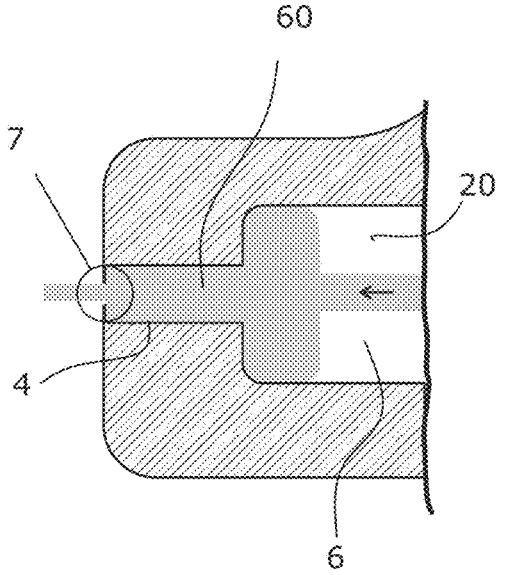
FIG. 4B shows a close up schematic at the outlet of the multi-phase rotor outlet.
Figure 4C:
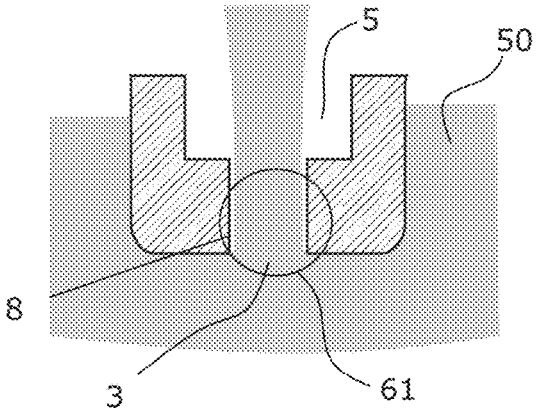
FIG. 4C shows a close up schematic at the inlet of the multi-phase rotor inlet.

As shown in FIG. 4A, the multi-phase rotor 1 comprises a liquid intake channel 5 extending from the inlet 3. An internal rotor cavity 6 extends radially around the liquid intake channel. Preferably, the internal rotor cavity 6 forms a ring around the liquid intake channel 5 as best shown in FIGS. 1 and FIGS. 5A-D.

The at least one outlet 4 is configured to expel the liquid from the internal rotor cavity 6. In some configurations the liquid being expelled is water. It is anticipated, other liquids may be transferred through the multi-phase rotor 1 including but not limited to water. Additionally, it should be understood that the liquid being introduced, transferred through and/or expelled from the multi-phase rotor 1 includes liquids with entrained gases. For example, in applications of the multi-phase rotor 1 where it is being used as a vacuum source, the liquid preferably has entrained gases.

To drive the liquid through the device, the multi-phase rotor 1 is configured to be rotatable about an axis of rotation. As the multi-phase rotor 1 rotates, liquid flows from the inlet 3 to the at least one outlet 4. The liquid flows along a liquid pathway 22 through the stable vapour cavity 20 shown schematically in FIG. 4A. It should be appreciated the specific path of the liquid pathway 22 is determined by the rotation and/or internal geometry of the rotor 1.

In some configurations, the at least one outlet 4 is located towards or at the outermost regions of the internal rotor cavity 6. Liquid exits approximately perpendicular to the liquid intake channel 5 inlet flow due to the rotational acceleration forces.

In other configurations, the at least one outlet 4 is in another region of the device and/or system.

Figure 11:
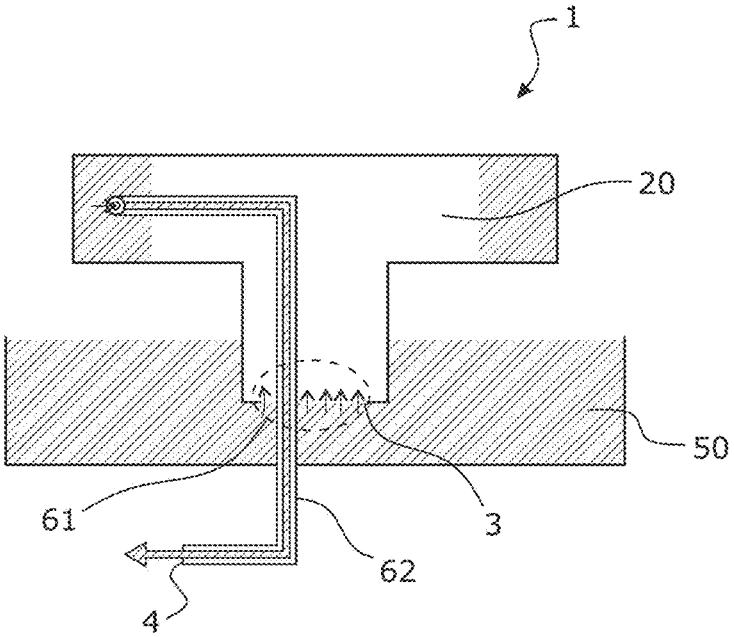
FIG. 11 shows a schematic view of a multi-phase rotor comprising an outflow conduit.

In some configurations, the at least one outlet 4 is provided by a conduit 62. Preferably, the outlet 4 is located at an end of the conduit 62, such that the liquid from the rotor 1 is allowed to exit (for example, as shown in FIG. 11).

Figure 2A:
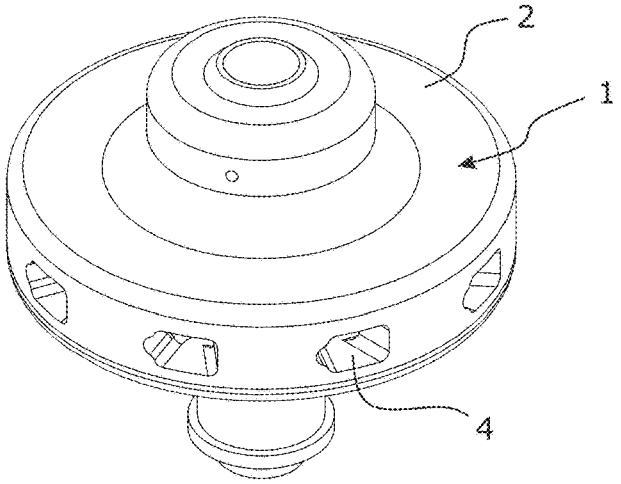
FIG. 2A shows a perspective view of the multi-phase rotor.
Figure 2B:
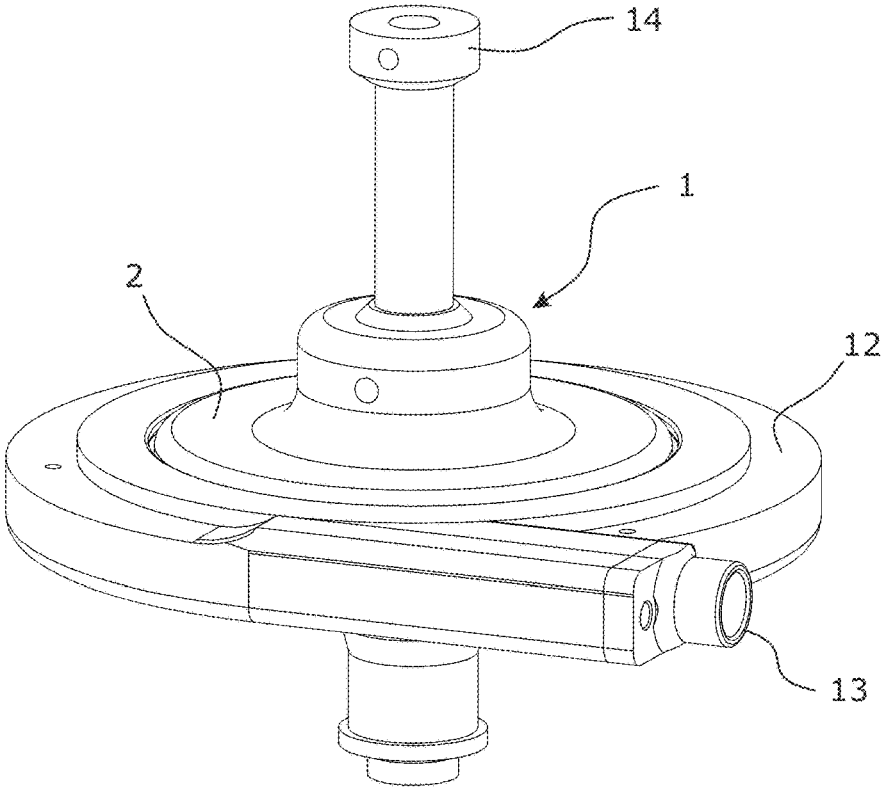
FIG. 2B shows a perspective view of the multi-phase rotor having a housing.
Figure 2C:
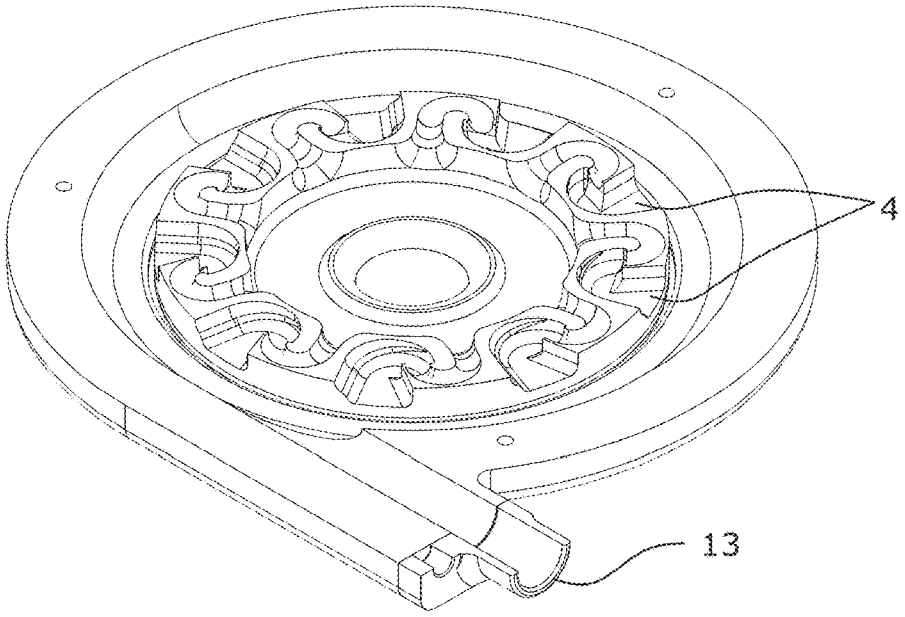
FIG. 2C shows a cross-section of the multi-phase rotor and housing.
Figure 2D:
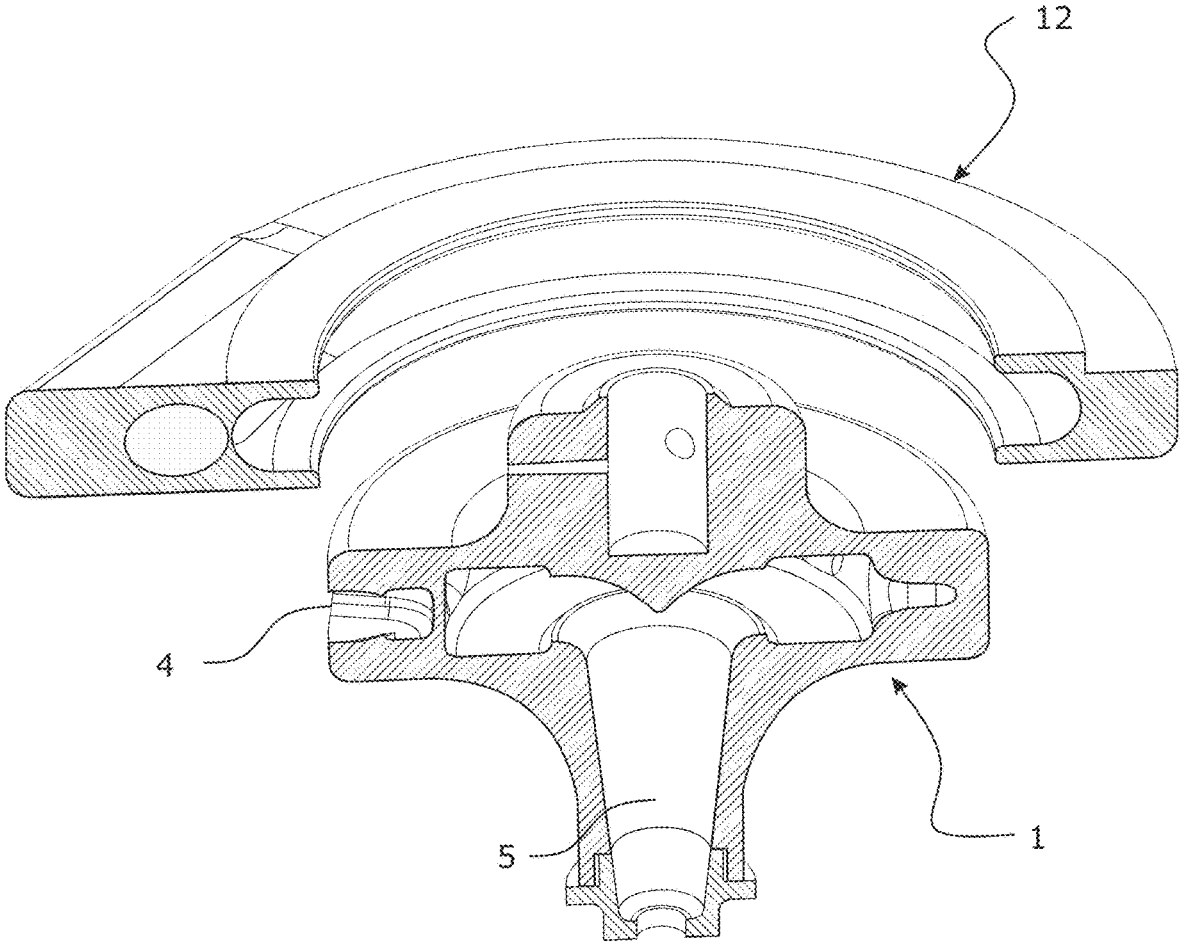
FIG. 2D shows a cross-section exploded view of the multi-phase rotor having a housing.
Figure 3:
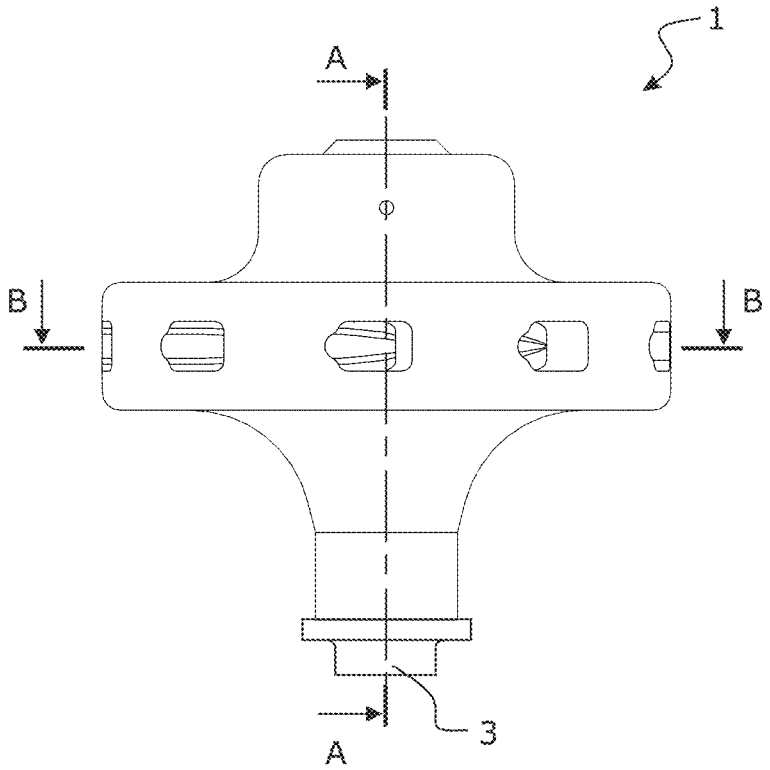
FIG. 3 shows a side view of the multi-phase rotor.

In some configurations, the multi-phase rotor 1 has a housing 12, as shown in FIGS. 2B-D. The housing comprises a housing outlet 13 for directing liquid out of the device once it exits the rotor 1. Liquid expelled from the at least one outlet 4 of the internal rotor cavity 6 is captured by the housing 12 and directed out of the device through the housing outlet 13. It should be noted that the multi-phase rotor 1 is a separate device from the housing 12.

It should be appreciated that the housing 12 of the present multi-phase rotor 1, is not necessary to facilitate displacement of liquid from the inlet 3 to the at least one outlet 4. The housing 12 collects and controls the exiting liquid after being expelled from the internal rotor cavity 6 of the rotor.

In some configurations, an attachment such as a hose can be connected to the housing outlet 13 to direct the liquid as required.

In other configurations, liquid freely flows out of the at least one outlet 4 without being captured and directed by the housing 12.

The internal geometries of the multi-phase rotor 1 move the fluid through the device, as the rotor rotates.

Acceleration and hence energy is transferred to the liquid in the rotor 1 as rotational motion is imparted to the liquid via contact with the vessel's internal surfaces.

In some configurations, the rotor 1 does not comprise of vanes or blades.

In contrast, conventional centrifugal pumps have a rotating impeller within a stationary housing. This housing is necessary for the impeller to be able to function and the characteristics for performance are complex. This interrelationship between the impeller and the housing, particularly between the impeller and the intake aperture in the housing is an area of high importance as the potential for cavitation and communication within the housing between the inlet aperture and the outlet aperture are typical limiting factors on a centrifugal pump's performance ability.

Centrifugal pumps are utilised as a comparison, simply because the severe negative impacts of cavitation are widely recognised in this application of rotating mechanisms within a liquid.

Figure 10:
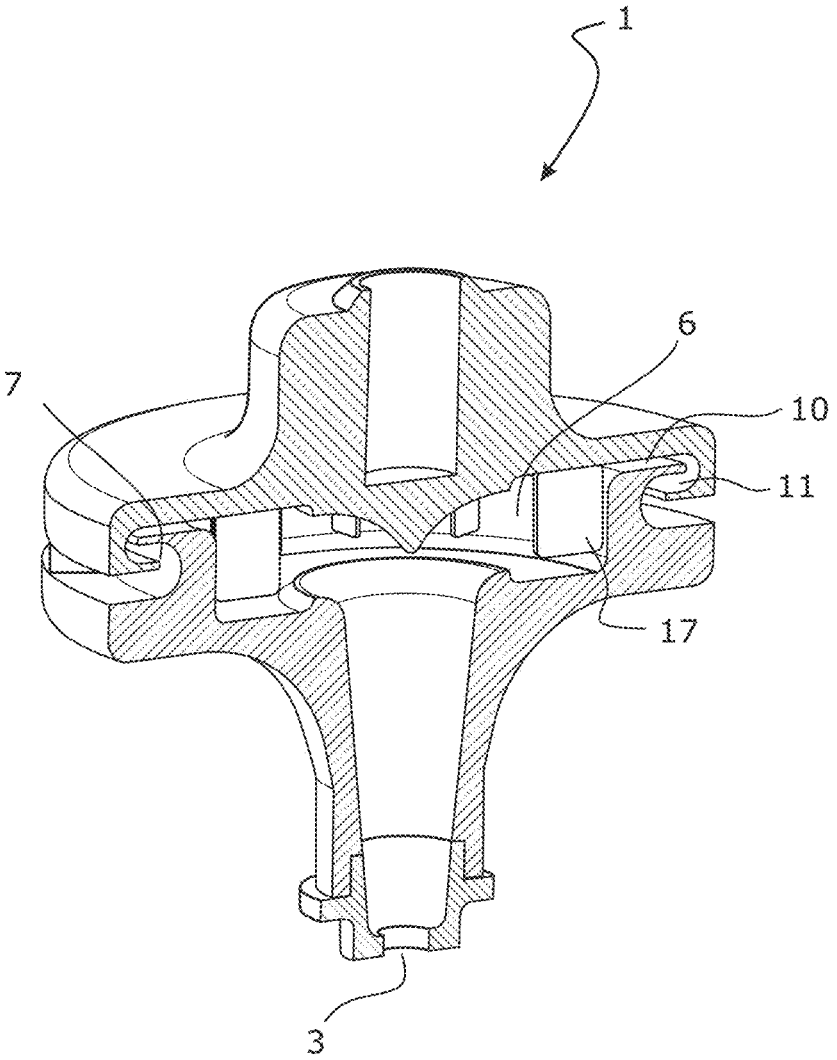
FIG. 10 shows a cross sectional plan view schematic of the multi-phase rotor comprising blades.

With reference to FIG. 10, in some configurations, the multi-phase rotor 1 comprises vanes or blades 17 in the rotor 1, for example within the internal rotor cavity 6. In these configurations, preferably the vanes or blades still allow the continuous stable vapour cavity 20 to be formed as described above. The vanes or blades 17 are fixed to or fixed relative to the disk body 2 of the rotor and as such rotates with the body. These vanes or blades 17 can impart accelerational energy to the liquid within the rotor.

It is anticipated this feature may be useful in configurations where additional energy is desired such as where there is a stationary structure within the rotor which disrupts the liquid flow (e.g., interrupting liquid flowing in an outward radial direction) within the internal rotor cavity 6. A stationary structure may be present in particular applications of the multi-phase rotor such as where the multi-phase rotor 1 is provided with a stationary conduit to access the vacuum or liquid within the internal rotor cavity 6 (as described below in applications 2 and 3 of the device.)

In other configurations, where vanes or blades 17 are not present, and there is disruption in the liquid, the multi-phase rotor 1 may spin faster to achieve the rotational speed required to overcome any disruption of the liquid flow within the rotor.

It should be understood, the multi-phase rotor 1 utilises the presence of non-damaging phase change in the rotational environment in order to provide the described functionalities. The multi-phase rotor 1 renders phase change within the operational liquid to be a very constructive occurrence in a rotating device whilst not adversely impacting the mechanism.

It should be appreciated that in the preferred configurations, the multi-phase rotor 1 has been designed to include simple internal geometries which are integrated into the body of the device. It is anticipated, the lack of interactional components inside the rotor 1 and/or simplicity of the rotor 1, improves the lifespan of the device and reduces potential wear typically associated with cavitation damage.

Liquid Flow Path Through Structure

Liquid is driven by the multi-phase rotor 1 from the inlet 3 to the at least one outlet 4, through the liquid intake channel 5 and the internal rotor cavity 6. A flow path is provided between the inlet 3 and the at least one outlet 4 by the liquid intake channel 5 and the internal rotor cavity 6.

To drive the liquid through the device, the multi-phase rotor 1 is configured to be rotatable about an axis of rotation. As the multi-phase rotor 1 rotates, liquid flows from the inlet 3 to the at least one outlet 4.

To drive the multi-phase rotor 1, preferably the rotor is coupled to a drive shaft 14 and a motor (not shown). The motor is connected to the shaft 14 to apply rotational torque to rotate the multi-phase rotor 1.

Figure 7A:
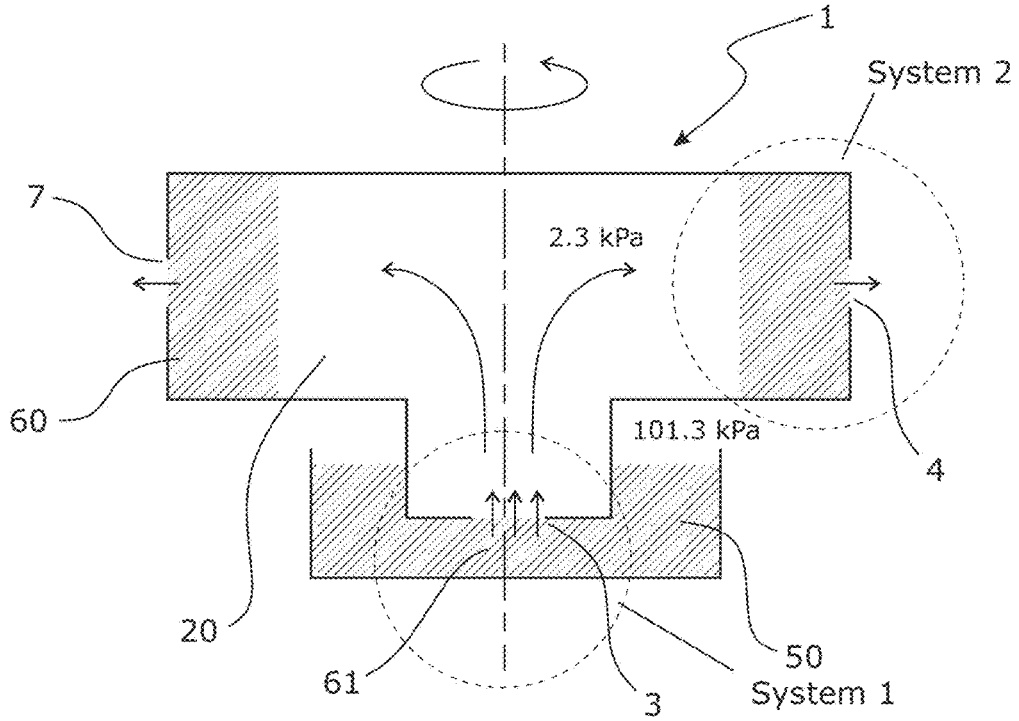
FIG. 7A shows a schematic view of a stable vapour cavity and seal forming system for displacing liquid.
Figure 7B:
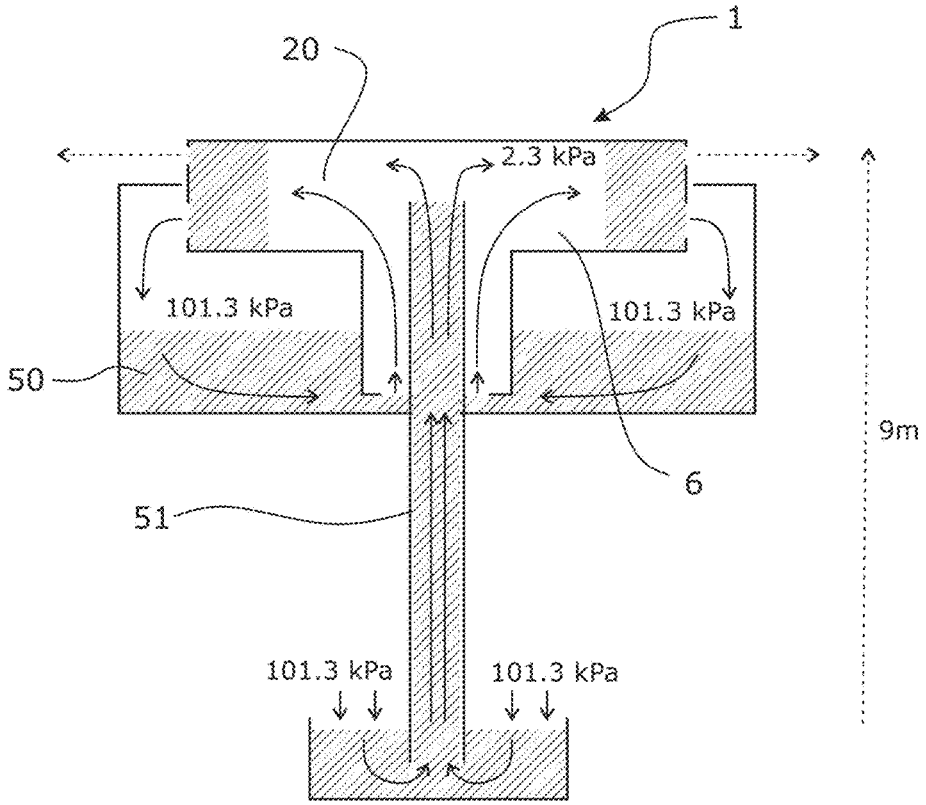
FIG. 7B shows a schematic view of a multi-phase rotor used in a system having a relative height difference between a liquid source and rotor outlet of 9 m for displacing liquid.

In the preferred configurations, the inlet 3 is located at a bottom of the rotor 1. Liquid can be introduced from a liquid source 50 through the inlet 3, as illustrated in schematics FIGS. 7A and 7B. In some configurations, the inlet 3 is immersed in a body of water or other source of liquid (example as shown in FIG. 7A). In other configurations, a conduit 51 supplies liquid from a body of water to the inlet 3 (example as shown in FIG. 7B).

In some configurations the source of liquid is a container of liquid.

Preferably, the liquid intake channel 5 extends vertically upwards from the inlet 3, as shown in FIG. 4A.

Preferably, the liquid intake channel is coaxial with the axis of rotation.

In the preferred configurations, the internal rotor cavity 6 is on a plane perpendicular to the axis of rotation, as shown in FIG. 4A. As the multi-phase rotor 1 rotates, liquid in the internal rotor cavity 6 is driven from a central region of the multi-phase rotor 1 towards the at least one outlet 4 located radially outwards at the periphery of the multi-phase rotor 1, by centrifugal force (rotationally induced accelerational forces).

Outlet Liquid Seal

In some configurations, the at least one outlet 4 preferably comprises an outlet restriction 7. In these configurations, the outlet restriction 7 is preferably located at or towards a periphery of the outlet 4 as best shown in close-up schematic of FIG. 4B. The outlet restriction 7 is a feature configured to maintain an outlet liquid mass 60 at the at least one outlet 4 at a pressure greater than its vapour-pressure to prevent cavitation occurring.

The outlet restriction 7 retains the outlet liquid mass 60 in the disk body 2 towards the outlet restriction 7 by forming an outlet liquid seal in the at least one outlet 4. As a result of the outlet restriction 7, the stable cavity is restricted from fluid communication with the ambient environment, i.e., a seal is formed. The outlet liquid seal forms between the external ambient environment (1 ATM) and the internal vapour-pressure pressure cavity, as the multi-phase rotor 1 rotates about the axis of rotation.

In some preferred configurations, the outlet restriction 7 prevents venting of external ambient gas into the stable vapour cavity 20 through the outlet liquid mass 60 (against liquid flow direction).

It should be appreciated during operation, the outlet liquid mass 60 which is maintained due to the outlet restriction 7, allows liquid to pass out via the at least one outlet 4, while sealing and preventing venting of ambient gas into the device via the outlet. The outlet liquid mass 60, is a liquid seal at the at least one outlet 4 which allows fluid outflow but prevents ambient gas inflow into the internal rotor cavity 6 and disruption of the stable vapour cavity 20.

In some configurations, the outlet restriction 7 is an outlet constriction where the outlet comprises a region of reduced area, that allows a body of fluid (when operating) to remain and seal the outlet from the ambient environment. Preferably, the outlet construction 7 is a region of reduced size at the at least one outlet (i.e., reduced cross sectional area) to facilitate the formation of the liquid seal.

In some configurations, the outlet restriction 7 has a diameter less than the inlet 3.

In some configurations, the outlet restriction 7 is approximately 2 mm to 6 mm in diameter.

In one configuration, the outlet restriction 7 is approximately 4 mm in diameter.

In some preferred configurations, the inlet 3 is approximately 3 mm to 8 mm in diameter.

Inlet Liquid Seal

In the preferred configurations, the inlet 3 preferably comprises a liquid seal maintained by an inlet liquid mass 61 at or towards the inlet 3 as shown in at least FIG. 4A. Preferably, an inlet restriction 8, is located at or towards a periphery of the inlet 3 as best shown in close-up schematic of FIG. 4C. The inlet restriction 8 is a feature configured to maintain an inlet liquid mass 61 at the inlet 3 at a pressure greater than its vapour-pressure to prevent unstable cavitation occurring.

The inlet restriction 8 limits liquid flow to form an inlet liquid seal, as provided by the inlet liquid mass 61 at the inlet 3 and facilitates the formation of vapour that populates the vapour cavity 20.

It should be appreciated that the inlet liquid seal at the inlet 3 allows liquid to pass through the inlet.

In some configurations, the inlet liquid seal 61 is formed around structures such as conduits which may pass through the inlet 3 (for example as shown in at least FIGS. 7B, 8, 11 and 12).

The presence of liquid seals in the multiphase rotor 1 allows liquid to pass through the inlet 3 and or outlets 4, while sealing and preventing venting of ambient gas into the device via the inlet or outlet. It should be appreciated in these configurations, the liquid seals can provide an effective seal for the rotor and can be advantageous over mechanical seals, primarily due to their simplicity and robustness, and eliminating wear and maintenance.

In some configurations, where the multiphase rotor 1 rests on a body of water (i.e., the liquid source) the liquid mass forming the liquid seal at or towards the inlet 3 is continually being replaced. The presence of liquid in the liquid source allows for the continual exchange of liquid forming the liquid seal, which in turn keeps the system stable.

In some preferred configurations, the inlet restriction 8 prevents venting of external ambient gas into rotor 1 through the inlet liquid mass 61. In some configurations, the inlet restriction 8 is an inlet constriction where the inlet comprises a region of reduced area, that allows a body of fluid (when operating) to remain in liquid form and seal the inlet from the ambient environment. Preferably, the inlet constriction 8 is a region of reduced size at the inlet 3 (i.e., reduced cross sectional area) to facilitate the formation of the inlet liquid seal.

In one configuration, the inlet 3 is approximately 3 mm in diameter.

In another configuration, the inlet 3 is approximately 6 mm in diameter.

In the preferred configurations, the multi-phase rotor 1 is operated at or above a stable cavity threshold rotational speed and hence the stable vapour cavity 20 is established and maintained. The greater flow capacity of the outflow system (FIG. 7, "System 2") versus the flow capacity of inlet system (FIG. 7, "System 1") causes the inflowing liquid to act as a physical sealing interface 8 between the vapour cavity 20 and the external ambient pressure (to be described in more detail below). It should be appreciated the liquid seal mechanism can facilitate communication both into and out of the multi-phase rotor 1.

Stable Vapour Cavity

Figure 5A:
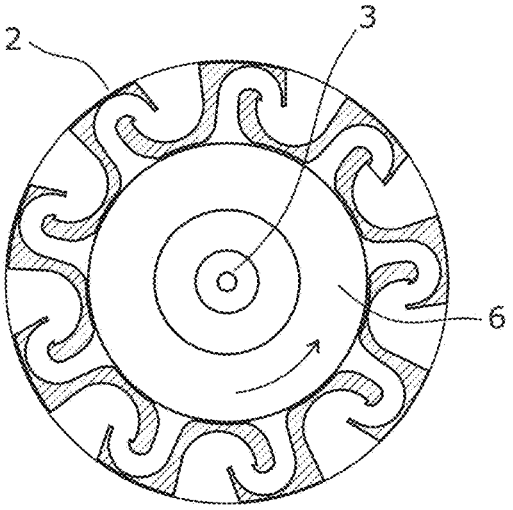
FIG. 5A shows a cross sectional plan view schematic of an empty multi-phase rotor.
Figure 5B:
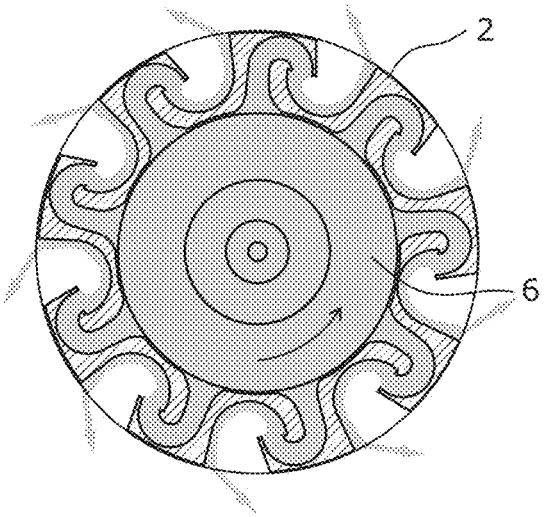
FIG. 5B shows a cross sectional plan view schematic of the multi-phase rotor filled with liquid in a pre-cavitation phase.
Figure 5C:
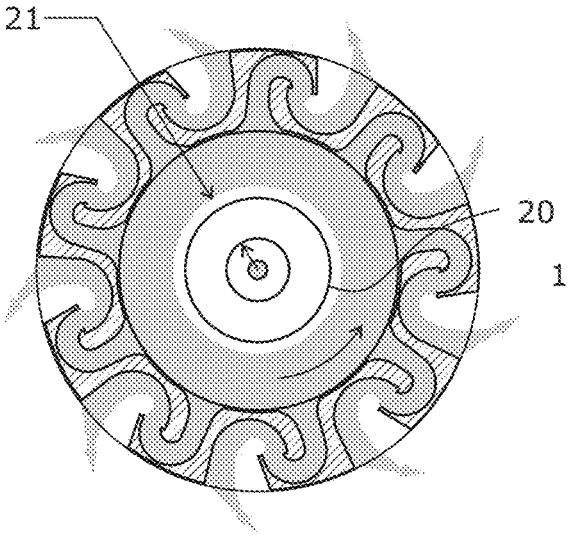
FIG. 5C shows a cross sectional plan view schematic of the multi-phase rotor having formed a stable vapour cavity in a post-cavitation phase.
Figure 5D:
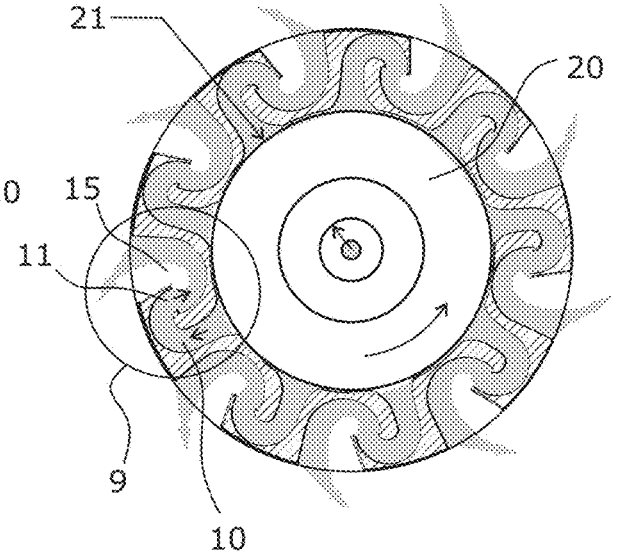
FIG. 5D shows a cross sectional plan view schematic of the multi-phase rotor having formed a stable vapour cavity in a post-cavitation phase at a rotational speed greater than FIG. 5C.

As the multi-phase rotor 1 rotates above a threshold rotational speed, a continuous stable vapour cavity 20 is formed in the internal rotor cavity 6, as best shown in schematic FIGS. 5C, 5D.

The continuous stable vapour cavity 20 is a low-pressure vapour cavity having a pressure less than an external ambient pressure. The low-pressure vapour cavity is comprised of saturated vapour at the given liquid's vapour-pressure pressure. For example:

- 20 Degrees Celsius water would generate a cavity pressure of approximately 2340 Pa—being the vapour-pressure of 20 Degrees Celsius water.
- 20 Degrees Celsius kerosine would generate a cavity pressure of approximately 700 Pa—being the vapour-pressure of 20 Degrees Celsius kerosine.

Preferably, the continuous stable vapour cavity 20 is formed between and separates the outlet liquid mass 60 at the at least one outlet 4 and an inlet liquid mass 61 located at the inlet 3, as shown in FIGS. 6C-F.

In the preferred configurations, there are two liquid flow systems within the multi-phase rotor 1, as referenced in FIG. 7A. System 1 is the "Intake System", and System 2 is the "Outflow System". The inter-relationship between System 1 and System 2 determines the cavitational state of the multi-phase rotor 1.

If System 1 (intake) has greater liquid mass flow capability than System 2 (outflow), the multi-phase rotor will be in "pre-cavitational" phase. There is, preferably, no phase change occurring (FIG. 6A).

If System 2 (outflow) has greater liquid mass flow capability than System 1 (intake), the multi-phase rotor 1 will be in an inter-cavitational phase (FIG. 6B) or post-cavitational phase (FIGS. 6C-6F). The inter-cavitational phase is dynamic and unstable. The onset of the inter-cavitational phase occurs when a "cavitation phase threshold rotational speed" is reached (i.e., the threshold RPM at which cavitation initially occurs). In the inter-cavitational phase of operation, cavitation is occurring continually wherein liquid changes state to gas and then back to liquid—this is classic cavitation.

With further increasing RPM a "stable cavity threshold rotational speed" is achieved (the threshold rotational speed the rotor rotates at to form and maintain the continuous stable vapour cavity). The post-cavitational phase is the preferred state of operation wherein the stable vapour cavity 20 has formed and remains stable. This stable state occurs at and continues beyond the "stable cavity threshold rotational speed". In this operational zone, phase change has been limited to, preferably, only the 'liquid to gas' (vapour) component of the cavitation cycle.

In the preferred configurations, the continuous stable vapour cavity 20 is formed at/above the stable cavity threshold rotational speed. The stable cavity threshold rotational speed is the RPM (speed of rotation) at which System 2 (Outflow System) develops both greater mass liquid flow capability than System 1's (Intake System) mass liquid flow capability and additionally overcomes the effects of ambient pressure opposing System 2's liquid mass outflow.

Preferably, stability is provided at/above a stable cavity threshold rotational speed, at/after which the stable vapour cavity 20 is established and can be maintained between the outlet and inlet liquid masses 60, 61.

Preferably, the stable cavity threshold rotational speed is greater than a cavitation phase threshold rotational speed at which cavitation initially occurs.

It should be understood that in the post-cavitational phase, the stable vapour cavity 20 is maintained within the internal rotor cavity 6 as the rotor continues to spin, even at higher speeds of rotation. This is in contrast to structures such as a traditional centrifugal pump which is unable to achieve high rotation speeds as unstable vapour cavities (cavitation) occurs thus compromising performance and/or damages the device.

For example, in a multi-phase rotor 1 with the liquid being 20 Degrees Celsius water, the observed operational "cavitation phase threshold rotational speed" may be approximately 5600 RPM and the observed operational "stable cavity threshold rotational speed" may be approximately 6500 RPM.

In the preferred configurations, System 1's liquid mass flow capability (at the inlet) is a function of the following:

a) the pressure within the multi-phase rotor 1 internal rotor cavity 6/vapour cavity 20,
b) external ambient pressure (aiding/causing flow), and
c) the size of inlet aperture 3.

In the preferred configurations, System 2's liquid mass flow capability (at the outlet) is a function of the following:

a) the pressure within the multi-phase rotor 1 internal rotor cavity 6/vapour cavity 20,
b) external ambient pressure (opposing flow)
c) the size of outlet aperture 4/outlet restriction 7, and
d) rotational speed, RPM.

In the preferred configurations of the multi-phase rotor 1, the physical relationships of the components establish the stable vapour cavity 20 as the rotor rotates at/above the stable cavity threshold rotational speed. Preferably, a compressive (push) force is applied to outlet liquid mass 60. As there is a physical vapour body separating the outlet liquid mass 60 at the outlet and the inlet liquid mass 61 at the inlet, acceleration forces push the out-going liquid-mass 60 through the at least one outlet 4 and the outlet restriction 7, thereby preventing the formation of unstable, deleterious cavitation.

Seals

It should be appreciated in the preferred configurations, the stable vapour cavity 20 is at a substantially lower pressure than the external ambient pressure. Preferably, the vapour cavity 20 is sealed on both sides (i.e., at the upstream/inlet 3 and downstream/outlet 4).

In the preferred configurations, the outlet restriction 7 of the at least one outlet 4 is restrictive enough to provide sufficient liquid depth of greater than vapour-pressure liquid to facilitate a stable liquid seal between the stable vapour cavity 20 and the external ambient (1 ATM) environment, on the external side of the outlet restriction 7.

It should be appreciated, the presence of the stable vapour cavity 20 separating the outlet and inlet liquid masses 60, 61 and there being a stable liquid seal allows rotational acceleration to exert a force that results in a compressive or "push" force on the outflowing liquid mass 60, resulting in the eradication of harmful cavitation as the liquid pressure is consequently maintained at greater than vapour-pressure pressure.

Liquid Trap Feature

In some of the preferred configurations, the multi-phase rotor 1 has a liquid trap outlet restriction 9, referenced in FIG. 5D. The liquid trap feature 9 is a modified geometry of the at least one outlet 4 and is an alternative type of outlet restriction described earlier.

The liquid trap feature 9, is an outlet restriction, configured to retain the outlet liquid mass 60 in the disk body 2 by forming a liquid seal in the at least one outlet, as the multi-phase rotor 1 rotates about the axis of rotation.

Preferably, this outlet restriction trap feature 9 prevents venting of external ambient gas into the stable vapour cavity 20 through the outlet liquid mass 60 (against liquid flow direction). The liquid trap feature 9 prevents air (ambient gas) moving back in through the outlet(s) 4 which would result in increasing the cavity pressure from vapour-pressure to ambient pressure. Such an occurrence can destroy the "vacuum" (vapour-pressure) i.e., destroying the stable vapour cavity 20.

Preferably, the liquid trap feature 9 traps the outlet liquid mass 60 and seals the low pressure in the rotor 1 from external ambient pressure at the outlet 4.

Preferably, the outlet restriction liquid trap feature 9 maintains the outlet liquid mass to provide a seal at the outlet between the stable vapour cavity 20 and ambient gas.

Preferably, the liquid trap feature 9 is a counter-acceleration routing geometry with respect to flow direction from a radial perspective.

Figure 5E:
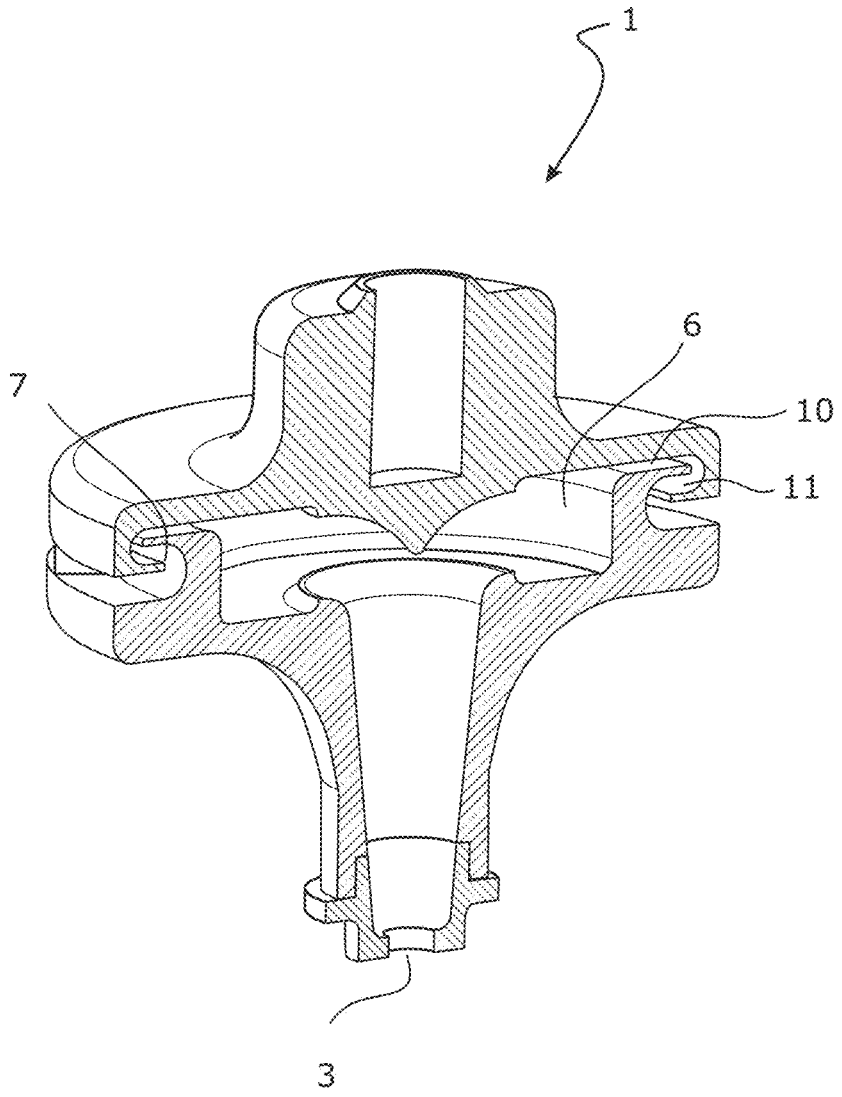
FIG. 5E shows a cross sectional side view perspective of the multi-phase rotor with a liquid trap feature.

In the preferred configuration, the liquid trap feature 9 is a S-trap arrangement as shown in FIGS. 1 and 5D and 5E. The liquid trap feature 9 in these configurations comprises legs 10, 11 which are substantially aligned radially. As the multi-phase rotor 1 rotates, liquid inside rotor cavity 6 is pushed radially outwards away from the axis of rotation into the first leg 10 of the liquid trap feature 9. The modified geometry of the liquid trap feature 9 redirects the liquid flow direction through the second leg 11 radially inwards towards the axis of rotation.

In these configurations, the inward facing second leg 11 experiences substantial RPM based proportional acceleration that counters the outlet liquid mass 60 flow direction and hence acts as a force based liquid flow restrictor i.e., the outlet restriction 7. This restriction causes rotational acceleration to exert a force that results in a compressive or "push" force on the outflowing liquid mass 60 in both legs 10, 11, such that the outflowing liquid pressure is consequently maintained at greater than vapour-pressure at the liquid trap feature 9.

The alignment of the second leg 11 of the liquid trap and acceleration force on the second leg are mechanisms which prevent external ambient gas ingress and maintains the outflow liquid at greater than vapour-pressure pressure. In these preferred configurations the liquid trap feature 9 maintains the continuous vapour cavity 20 and prevents deleterious cavitation.

Preferably, an exit leg 15 is provided for egress of the liquid downstream second leg 11, as referenced in FIG. 5D. It should be appreciated the exit leg 15 is not critical in maintaining the stable vapour cavity 20, provided it does not influence the flow characteristics of liquid trap feature 9. The purpose of exit leg 15 is to provide a flow pathway out of the rotor 1.

It should be appreciated, in these preferred configurations, the liquid trap feature 9 allows the rotor 1 to spin at higher rotational speeds than a device without this feature by preventing venting and subsequent collapse of the stable vapour cavity 20.

Preferably, the liquid trap feature 9 comprises an exit path to the perimeter, substantially larger in cross-sectional area the first and second leg(s) 10, 11 being open to ambient environment for outflow of liquid.

In one configuration, the liquid trap feature 9 is shown in FIG. 5E in a 'pond and weir' arrangement.

It should be appreciated that flow restriction provided by the outlet restriction 7, at the multi-phase rotor 1 at the at least one liquid outlet 4 in the outlet liquid mass 60 flow route helps establish and maintain a stable vapour cavity 20. The restriction to flow can be either via a physical constriction 7 (for example shown in FIG. 4*b*) or via a force based liquid trap feature 9 (for example shown in FIG. 5D). Both features are outlet restrictions to restrict outflow and configured to maintain the outlet liquid mass 60 at the at least one outlet 4 at a pressure greater than its vapour-pressure. The outlet restriction 7 facilitates the formation of the vapour cavity and helps maintain the continuous stable vapour cavity 20.

It should be appreciated that the liquid trap feature 9 provides a robust solution especially at higher RPMs. It should therefore be appreciated that many geometrical arrangements can be derived to facilitate a liquid flow path radially inwards (substantially or partially decreasing radii geometric/directional component etc.) towards the axis of rotation delivering counter flow acceleration forces providing the liquid trap feature 9 functionality.

Operation of Device

FIGS. 5A to 5D illustrates the phases of the multi-phase rotor 1 in plan view schematics.

As shown in FIG. 5A, there is a multi-phase rotor 1 which is empty, with no liquid.

As shown in FIG. 5B, starting with the rotor 1 full of liquid and inlet 3 immersed into a body of liquid.

As the multi-phase rotor 1 rotates, the liquid in the internal rotor cavity 6 travels from the centre of the device radially outwards towards the at least one outlet 4. This creates a relative low pressure around the centre region of the internal rotor cavity and in the liquid intake channel 5, relative to external pressure at the inlet 3. The external pressure outside/upstream of the inlet 3 pushes the liquid into the lower-pressured intake channel zone 5, and further into the internal rotor cavity 6. Preferably, the rotor 1 spins to initially fill with fluid such that the rotor is self-priming.

In some configurations, the liquid intake channel 5 (as shown in FIG. 2D) comprises a cone shape for self-priming. The liquid channel 5 in these configurations can pull liquid into the channel from the liquid source 50. A slight enlarging taper (in the direction of flow) of the internal walls on the structure surrounding the intake channel 5 allows robust self-priming of the multi-phase rotor 1.

Hence liquid moves from the inlet 3 to the at least one outlet 4 as the rotor 1 rotates around its axis. The rotor initially operates in a pre-cavitation phase where liquid flows through the device as a single body of liquid without vapour filled cavities.

As shown in FIG. 5C, the rotor is operating in a post-cavitation phase. As the rotor continues to spin with higher rotational speed above a stable cavity threshold rotational speed, a stable vapour cavity 20 in the internal rotor cavity 6 is formed, the stable vapour cavity 20 having a cavity diameter 21.

The vapour cavity 20 is formed as the acceleration upon the liquid mass in the internal rotor cavity 6 causes a liquid outflow demand which is greater than the acceleration afforded by the external 1 ATM of pressure on the liquid at the inlet can supply.

Once the stable vapour cavity 20 is formed, it is stable over a large range of rotational speeds in the preferred configurations.

It is anticipated that the threshold rotational speeds, both "cavitation phase threshold" and "stable cavity threshold" can vary greatly.

Apart from external ambient conditions and device idiosyncrasies, the variables that determine the actual threshold RPMs include the following variables:

a) System 1 inlet aperture size,
b) System 2 at least one outlet aperture size,
c) Liquid vapour-pressure, both its physical characteristics and it's actual temperature.

As shown in FIG. 5D, the rotor continues to operate in the post-cavitation phase at a higher rotational speed than shown in FIG. 5C. The cavity diameter 21 increases with rotational speed such that the cavity diameter at higher rotational speeds (FIG. 5D) is greater than at low rotational speeds (FIG. 5C). It is anticipated at even higher rotational speeds; the stable vapour cavity expands into the first leg of the liquid trap feature 9.

In these high rotational speeds, the liquid trap feature 9 maintains the stable vapour cavity as it seals the internal rotor cavity 6 from downstream external ambient with a ring of liquid to prevent ambient pressure at the at least one outlet 4 from entering and hence compromising the stable vapour cavity 20.

In some preferred configurations, the multi-phase rotor 1 can operate in the post-cavitation phase at high RPMs. Modelling of the device demonstrates that rotor speeds of 35,000 RPM are readily achieved with no indicative loss of function. Stable operation has been demonstrated up to 20,000 RPM on functional apparatus. Theoretical expectations offer no obvious RPM threshold apart from the realities of power, mechanical and material limitations.

System/Use of Device

The multi-phase rotor 1 has the ability to create and maintain a vapour-pressure vapour cavity 20. This stable low-pressure cavity 20, within the framework and conditions as previously described, offers a varied array of functional opportunities, including pressure based applications.

Further, in the preferred configurations, the liquid masses 60, 61 provides a pressure sealing interface between the multi-phase rotor 1 and the external environment i.e., sealing is achieved via the liquid itself. This aspect may have further positive implications, for example: in maintaining separation and/or isolation when sensitive/harmful liquids are being utilised within the framework of the multi-phase rotor's functional capabilities. In the preferred configurations, bushes/bearings and seals needing to be in close contact with the liquid is not necessary. As the liquid seal is not a physical/mechanical item it is not subject to damage/wear/chemical-attack that would often be the case with conventional physical pressure/isolation seals.

Some applications of the multi-phase rotor 1 will now be described. It should be appreciated, the multi-phase rotor 1 may be used in other applications not described herein.

Application 1: Liquid Displacement Device

The multi-phase rotor 1 displaces liquid (i.e., liquid flowing through it), as a result of the previously described mechanisms, to provide both the sealing and the continuous stable vapour cavity. In one application, of the multi-phase rotor 1, the liquid flow through the multi-phase rotor 1 can be utilised.

For example, the multi-phase rotor 1 in some configurations, can have a housing 12 'wrapped' around. The housing 12 simply acts as a collection device for the liquid exiting the multi-phase rotor 1. The addition of the optional housing 'accessory' 12 to the multi-phase rotor 1 allows purposeful collection and control of the outflow liquid.

In the post-cavitation phase, preferably, the flow rate of liquid into the multi-phase rotor is independent of rotational speed of the rotor. The flow rate into the multi-phase rotor 1 is a function of: the liquid's vapour-pressure, atmospheric pressure, the inlet diameter and the relative heights of the multi-phase rotor and the liquid source.

In the preferred configurations, the operational characteristics of the multi-phase rotor 1 cause atmospheric pressure to push liquid against gravity into vapour cavity 20 of the multi-phase rotor 1. The potential height relativity of the rotor is directly related to the equivalent metres of head for the liquid's vapour-pressure at its given temperature. For example, and with reference to FIG. 7B, 20-degree Celsius water has a vapour-pressure of approximately 2.3 kPa, which translates to the atmospheric pressure (at sea level) being able to push water through a conduit 51 to the multi-phase rotor at a height of approximately 10.09 m potential difference. At this height relativity (10.09 m) there would be no flow, however, if there was a relative height difference of 9 m—for example, and an inlet orifice of 20 mm diameter—for example, the following scenario exists:

Liquid intake lift height 9 m

Intake potential pressure 2.3 kPa

Flow through 20 mm diameter

Approximately 1.431/s

This output flow can consequently be increasingly accelerated—via increasing RPM, without impacting the stable operating conditions generated by/in the multi-phase rotor 1

Figure 9:
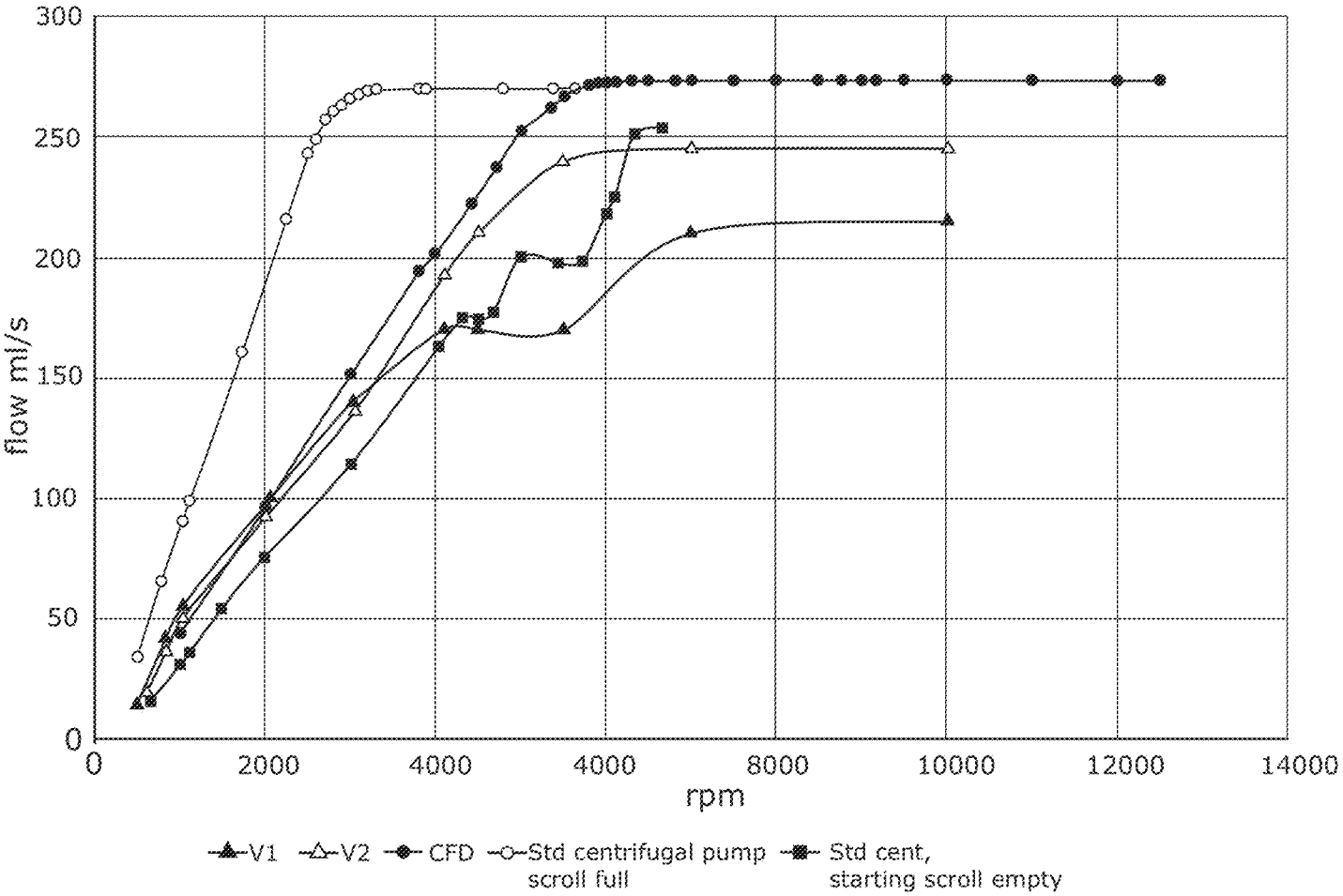
FIG. 9 shows a graph of flow rate vs. rotational speed comparing the operation of the stand-alone multi-phase rotor and a traditional centrifugal pump.

In the preferred configurations, the multi-phase rotor 1 provides a constant outflow rate of liquid ejected from the at least one outlet 4 (being equal to inlet liquid mass flow) at any rotational speed in the post-cavitation phase, as shown in the graph of FIG. 9, and hence the RPM can be increased to add energy to the outflow liquid, without negative consequence. In comparison, a standard centrifugal pump is unable to achieve high rotation speeds as unstable vapour cavities (cavitation) form compromising—if not destroying, performance and damaging the device. FIG. 9 shows the normal centrifugal pump—impeller and housing, to stop pumping liquid at approximately 6000 RPM whilst the multi-phase rotor 1 continued to 15000 RPM where the simulation concluded, with no change in flow performance.

In these configurations, the multi-phase rotor 1 can eject high velocity liquid, if desired. This, in turn can be converted to pressure, thrust, or other forms of energy required in different applications.

Preferably, the outlet restriction 7 and/or trap 9 features, maintain greater than vapour-pressure conditions within the outflowing outlet liquid mass 60. The multi-phase rotor 1 is thus able to apply accelerational energy in a compressive or 'push' manner to the liquid as it transits the multi-phase rotor 1. This outflow liquid's 'velocity' has a potential speed (m/s) component equal to or greater than the multi-phase rotor's 1 rotational speed (m/s) at the outflow-liquid's point of departure from the rotor 1. Thus, the increasing application of accelerational energy can be 'absorbed' by the liquid.

Application 2: Vacuum Source

In some configurations, the system including the multi-phase rotor 1 is used as a vacuum source. This system provides a vacuum source, by facilitating external accessibility to the stable low-pressure region (vapour cavity 20) maintained within the multi-phase rotor 1 in the post-cavitation phase. The multi-phase rotor 1 in these configurations provides a 'vacuum' source via moving a liquid whilst utilising the liquid's physical characteristics to provide both a seal and the 'vacuum'.

Furthermore, the stable low pressure cavity 20 (at the operational liquid's vapour-pressure) existent within the rotational environment provided by the rotating multi-phase rotor 1, establishes an internal isolated environment—whilst being in a liquid flow path/circuit bounded by ambient conditions, in which purposeful and productive non-deleterious liquid/gas phase change—including cavitation, can be facilitated and harnessed.

Figure 8:
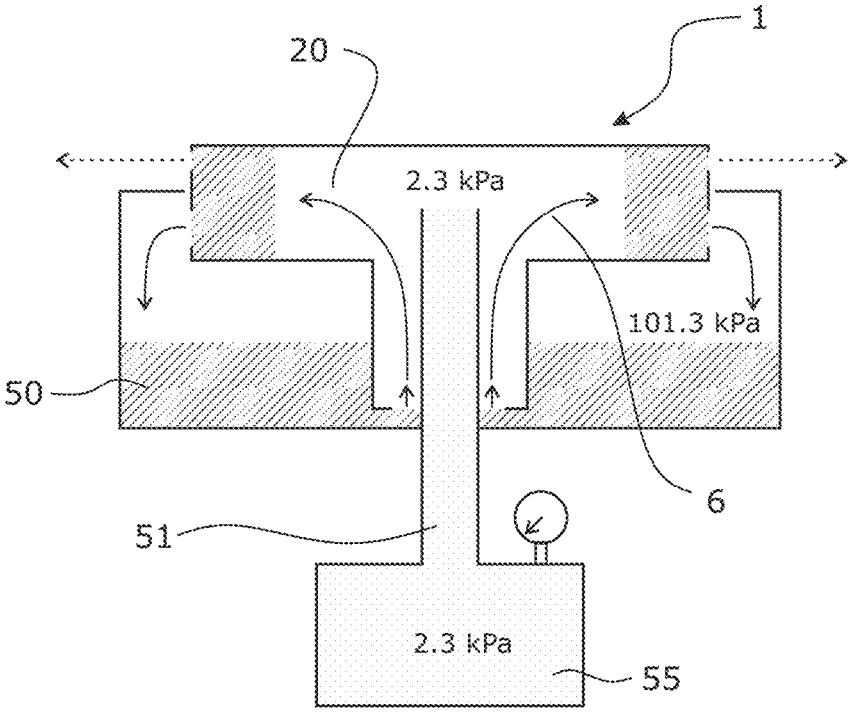
FIG. 8 shows a schematic view of a stable vapour cavity and seal forming system for providing a vacuum source.

In these configurations, the system has a conduit 51, as shown in FIG. 8, extending between the internal rotor cavity 6 and an external container/chamber 55. The conduit 51 provides access to the stable low pressure vapour cavity 20 in the internal rotor cavity 6.

The stable vapour-pressure vapour cavity 20, is a low-pressure environment, which is the result of liquid turning to vapour. The low-pressure environment or vapour-pressure vapour cavity 20, is a 'vacuum' within the internal rotor cavity 6 as a result of the previously described processes and mechanisms.

It will be appreciated that differing liquids can be used to facilitate different vacuum levels within the stable vapour cavity 20 as a result of the specific liquid's vapour-pressure characteristics.

This method of vacuum generation has significant applications both directly and indirectly. The following listed items are for example only and do not represent an exhaustive list of the possibilities or applications. It should also be noted that whilst water is cited as the operational liquid in the following scenarios other liquids can also be utilised.

Some direct applications include:

a) Priming of siphonic flow systems to remove the gas in the system accessing it from the 'apex' of the siphon, b) The system facilitates flow of both liquid and gas at low pressures without mechanical or system compromise which is useful for applications such as VMD (Vacuum Membrane Distillation), c) Evacuation of gases that would attack a typical vacuum pumps lubricant/oil.

The viability to utilise water—for example, as a continuous and replaceable vacuum media.

Application 3: Outflow of Liquid Through Conduit

Figure 12:
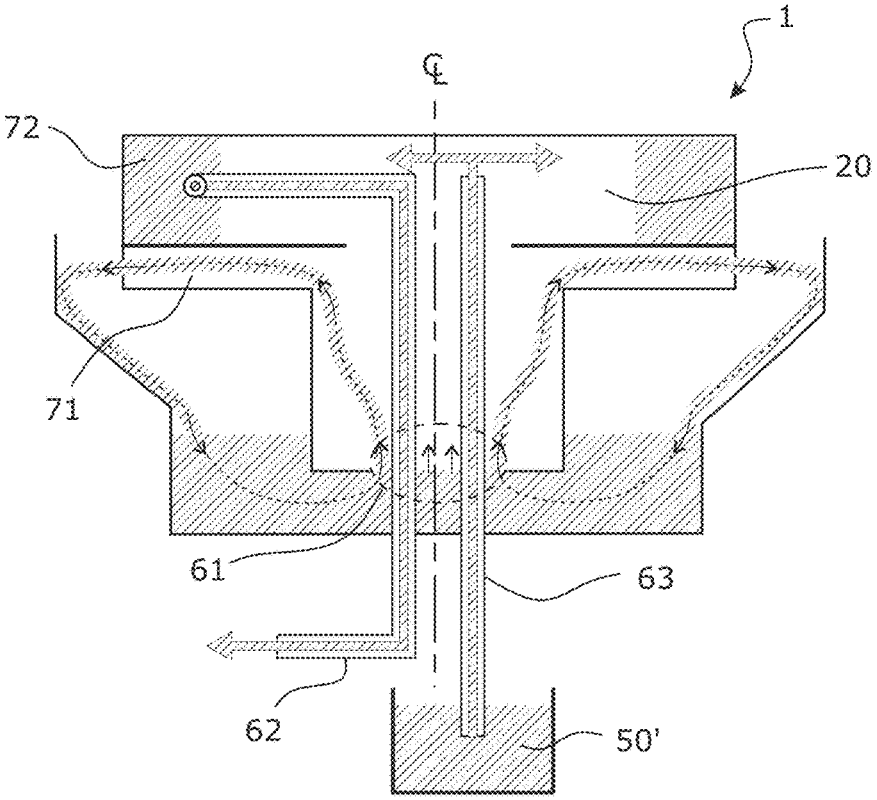
FIG. 12 shows a schematic view of a multi-phase rotor comprising an outflow conduit and an inflow conduit.

In another configuration, the multi-phase rotor 1 can utilise the liquid flow through the rotor and direct it out as desired, for example as shown in the schematics of FIGS. 11 and 12. In these configurations, the stable vapour cavity forming system further comprises an outflow conduit 62 to provide a liquid pathway for the liquid from within the internal rotor cavity 6 and purposefully direct the outflow liquid. The outflow conduit 62 provides access to the liquid within the internal rotor cavity 6, the liquid channeled out to be used as desired. Preferably, the outflow conduit 62 is stationary relative to the rotating multi-phase rotor 1.

Preferably, one end of the outflow conduit 62 is positioned at or towards a peripheral of the internal rotor cavity 6. The outflow conduit 62 is in fluid communication with liquid collected at the outer regions of the internal rotor cavity 6 (due to centrifugal force as the rotor rotates). Preferably, the other end of the outflow conduit 62 is located external to the rotor disk body 2 (to provide an outlet for the rotor).

Preferably, in these configurations, the multi-phase rotor 1 provides a useful high velocity liquid out via the outflow conduit 62. Optionally this high velocity can be converted to high pressure as required in different applications.

The liquid collected in the internal rotor cavity 6 at or towards the periphery of the rotor body has accelerational energy due to the compressive or 'push' manner of the liquid as it passes through the multi-phase rotor 1.

It should be appreciated in these applications where a stationary conduit is present in the internal rotor cavity 6, blades or vanes as shown in FIG. 10 may be advantageous to more effectively impart energy to the liquid as described above.

The formation of the stable vapour cavity 20 allows for high rotational speed in the post-cavitation phase, and hence the RPM can be increased to add energy to the liquid collected at the periphery of the internal rotor cavity 6, without negative consequence. The system works to provide a continual high velocity/pressure outflow of liquid where the outlet capability exceeds the inlet delivery.

Again, this is in contrast to standard/traditional centrifugal pumps which are unable to achieve high rotation speeds as unstable vapour cavities (cavitation) form compromising—if not destroying, performance and potentially damaging the device.

It should be appreciated a scroll or housing is not required in these configurations to capture the energised liquid.

In some configurations, as shown in schematic of FIG. 12, the multi-phase rotor 1 further comprises an intake conduit 63. The intake conduit 63 extending into the internal rotor cavity 6. The intake conduit 63 preferably introduces liquid into the internal rotor cavity 6 from a liquid source 50.' The liquid source 50' may be an additional source of liquid separate from the body of liquid which the rotor 1 may sit on. It should be appreciated in these configurations, providing an intake conduit may provide advantages such as providing a separate flow path, and allow for flexibility when providing a liquid source.

In some configurations, the multi phase rotor 1 comprises some features or principles of a pitot pump such as where a pitot tube is present (a type of outflow conduit 62 as described above.) As shown in the schematic of FIG. 12, in some configurations, the device may have a first chamber 71 where the standard operation of the multiphase rotor 1 occurs as described above. In some configurations, the device further comprises a second chamber 72 which provides features of a pitot pump.

Preferably, the first chamber 71 is the part of the device which acts as a multiphase rotor to form a stable vapour cavity 20 as described above, and to create the operational environment for the second chamber 72 to act as a pitot pump. In this environment, fluid is drawn up from the fluid source 50' and enters the second (pitot) chamber 72. The liquid is expelled out via the pitot tube/outflow conduit 62 which remains stationary while the chambers 71, 72 of the rotor rotate.

As shown in FIGS. 13-D, various geometries, and location of the outflow conduit 62 relative inlet 3 can be utilised while maintaining a liquid seal at the inlet 3.

Figure 13A:
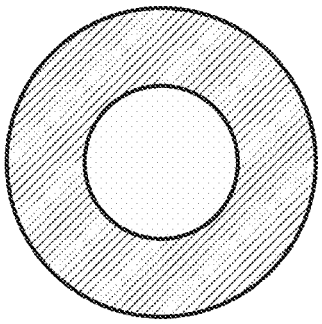
FIG. 13A-D shows schematics of various conduit geometries and position relative to an inlet of the multi-phase rotor.
Figure 13B:
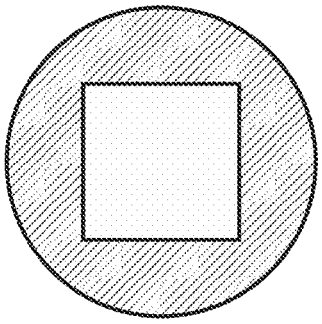
Figure 13C:
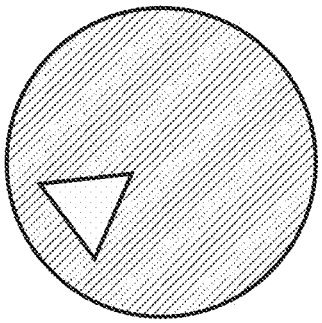
Figure 13D:
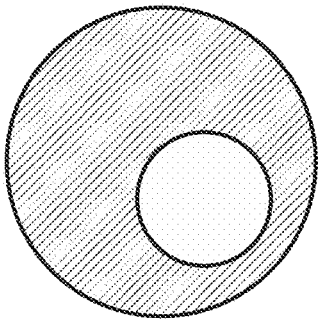

Optionally, the inflow and/or outflow conduit 63, 62 is non-coaxial relative to the inlet 3 and/or the axis of rotation of the rotor 1 as shown in FIGS. 13C and 13D.

In some configurations, the inflow and/or outflow conduit 63, 62 is circular (example shown in FIGS. 13A and 13D). In other configurations, other geometries such as squares, triangles etc. may be used (FIGS. 13B and 13C).

To those skilled in the art to which the invention relates, many changes in construction and widely differing embodiments and applications of the invention will suggest themselves without departing from the scope of the invention as defined in the appended claims.

This invention may also be said broadly to consist in the parts, elements and features referred to or indicated in the specification of the application, individually or collectively, and any or all combinations of any two or more of said parts, elements or features, and where specific integers are mentioned herein which have known equivalents in the art to which this invention relates, such known equivalents are deemed to be incorporated herein as if individually set forth.

The invention claimed is:

1. A multi-phase rotor comprising:

a disk body, the rotor configured to be rotatable about an axis of rotation;

an inlet to receive a liquid into the rotor;

a liquid intake channel extending from the inlet;

an internal rotor cavity extending radially around the liquid intake channel, the internal cavity is inside the disk body; and at least one outlet configured to expel the liquid from the internal rotor cavity;

wherein a flow path is provided between the inlet and the at least one outlet by the liquid intake channel and internal rotor cavity;

and wherein a continuous stable vapour cavity is formed in the internal rotor cavity as the rotor rotates above a stable cavity threshold rotational speed;

wherein the inlet comprises an inlet restriction configured to constrain an inlet liquid mass at the inlet forming a liquid seal at the inlet as the rotor rotates about the axis of rotation; and wherein the at least one outlet comprises an outlet restriction configured to retain an outlet liquid mass towards the outlet forming a liquid seal at the outlet as the rotor rotates about the axis of rotation.

2. The multi-phase rotor as claimed in claim 1 wherein the continuous stable vapour cavity is formed between and separates the outlet liquid mass at the respective outlet and an inlet liquid mass located at the inlet.

3. The multi-phase rotor as claimed in claim 1 wherein the internal rotor cavity forms a ring around the liquid intake channel.

4. The multi-phase rotor as claimed in claim 1 wherein the stable cavity threshold rotational speed is greater than a cavitation phase threshold rotational speed at which cavitation initially occurs.

5. The multi-phase rotor as claimed in claim 1 wherein the at least one outlet comprises a plurality of outlets.

6. The multi-phase rotor as claimed in claim 1 wherein the liquid seal at the outlet allows liquid to pass out through the at least one outlet, and the liquid seal(s) prevent venting of ambient gas into the rotor through the inlet and/or the at least one outlet.

7. The multi-phase rotor as claimed in claim 1 wherein the outlet restriction is a region of reduced area of the respective outlet, and wherein the at least one outlet has a diameter less than the inlet.

8. The multi-phase rotor as claimed in claim 7, wherein the at least one outlet is 2 mm to 6 mm in diameter.

9. The multi-phase rotor as claimed in claim 8, wherein the at least one outlet is approximately 4 mm in diameter.

10. The multi-phase rotor as claimed in claim 1 wherein the outlet restriction is a liquid trap feature located at the at least one outlet to prevent venting of ambient gas through the outlet liquid mass into the continuous stable vapour cavity and the liquid trap feature maintains the outlet liquid mass such that the liquid seal at the respective outlet is between the stable vapour cavity and ambient gas.

11. The multi-phase rotor as claimed in claim 1 wherein the liquid trap feature is a S-trap.

12. The multi-phase rotor as claimed in claim 1 wherein the inlet is located at a bottom of the rotor and the liquid intake channel extends vertically upwards from the inlet, and optionally the liquid intake channel comprises a cone shape for self-priming.

13. A stable vapour cavity forming system comprising:

a multi-phase rotor as claimed in any one of the previous claims; and a liquid source.

14. The stable vapour cavity forming system as claimed in claim 13 wherein the system is used to pump liquid; and optionally the system further comprises a conduit extending between the internal rotor cavity and an external of the rotor to provide a vacuum source; and optionally the system further comprises an outflow conduit extending between the internal rotor cavity and an external of the rotor to provide a fluid flowpath for liquid exiting the internal rotor cavity; and optionally the system further comprises an intake conduit extending into the internal rotor cavity to introduce liquid into the rotor from the liquid source.

15. A method for maintaining a stable vapour cavity comprising:

providing a multi-phase rotor comprising:

a disk body, the rotor configured to be rotatable about an axis of rotation;

an inlet to receive a liquid into the rotor;

a liquid intake channel extending from the inlet;

an internal rotor cavity extending radially around the liquid intake channel; and at least one outlet configured to expel the liquid from the internal rotor cavity;

wherein a flow path is provided between the inlet and the at least one outlet by the liquid intake channel and internal rotor cavity; and wherein a continuous stable vapour cavity is formed in the internal rotor cavity as the rotor rotates above a stable cavity threshold rotational speed;

introducing a liquid to the rotor through the inlet; and spinning the rotor;

the multi-phase rotor operates in a pre-cavitation phase, inter-cavitational phase and a post-cavitation phase and the stable vapour cavity is formed and maintained in the post-cavitation phase; and in the post cavitation phase the continuous stable vapour cavity forms around the liquid intake channel.

16. The method as claimed in claim 15 wherein the rotor spins to initially fill with fluid such that the rotor is self-priming.

17. The method as claimed in claim 15 further comprising spinning the rotor above a stable cavity threshold rotational speed to form the stable vapour cavity in the internal rotor cavity.

18. The method as claimed in claim 17 wherein the multi-phase rotor comprises an intake system and an outflow system, the method further comprising spinning the rotor such that the outflow system comprises a greater liquid mass flow capability than the intake system to form the stable vapour cavity in the post-cavitational phase, and wherein the intake system comprises a greater liquid mass flow capability than the outflow system in the pre-cavitational phase.

19. The method as claimed in claim 15 wherein the continuous stable vapour cavity forms around the liquid intake channel in plan view, the continuous stable vapour cavity comprises a cavity diameter.

* * * * *